US007995934B2

(12) United States Patent
Suzuki

(10) Patent No.: US 7,995,934 B2
(45) Date of Patent: Aug. 9, 2011

(54) DEVELOPING DEVICE, IMAGE FORMING APPARATUS, AND PROCESS UNIT

(75) Inventor: Yuji Suzuki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 260 days.

(21) Appl. No.: 12/211,302

(22) Filed: Sep. 16, 2008

(65) Prior Publication Data

US 2009/0080913 A1 Mar. 26, 2009

(30) Foreign Application Priority Data

Sep. 20, 2007 (JP) ..... 2007-243277
Nov. 1, 2007 (JP) ..... 2007-285356

(51) Int. Cl.
*G03G 15/08* (2006.01)

(52) U.S. Cl. ..... 399/30; 399/9; 399/12; 399/24; 399/25; 399/27; 399/28; 399/29; 399/110; 399/119; 399/120

(58) Field of Classification Search ..... 399/12, 399/9, 24, 25, 27, 28, 29, 30, 110, 119, 120
See application file for complete search history.

(56) References Cited

U.S. PATENT DOCUMENTS 5,434,656 A * 7/1995 Nagaoka et al. ..... 399/106
6,700,595 B2 3/2004 Sugiyama et al.
6,898,406 B2 5/2005 Suzuki et al.
7,027,753 B2 4/2006 Suzuki
7,184,678 B2 2/2007 Ishii et al.
2004/0202485 A1* 10/2004 Uyama ..... 399/27
2004/0220883 A1* 11/2004 West ..... 705/75
2005/0244170 A1* 11/2005 Ono et al. ..... 399/12
2007/0104516 A1 5/2007 Katoh et al.
2007/0127941 A1 6/2007 Ishii et al.

FOREIGN PATENT DOCUMENTS

JP 11-272061 10/1999
JP 2001-66872 3/2001
JP 3308126 5/2002
JP 2005-134796 5/2005
JP 2005-346102 12/2005
JP 2006-317889 11/2006
JP 2007-225813 9/2007

* cited by examiner

*Primary Examiner* — David P Porta
*Assistant Examiner* — Shun Lee
(74) *Attorney, Agent, or Firm* — Oblon, Spivak, McClelland, Maier & Neustadt, L.L.P.

(57) ABSTRACT

An information attaching unit attaches either one of carrier density information of initial developer and loose apparent density information of toner in the initial developer to a housing of a developing device. A density-information storage unit stores therein either one of the carrier density information and the loose apparent density information as electronic data. At least one of the information attaching unit and the density-information storage unit is provided before shipment of the developing device.

19 Claims, 9 Drawing Sheets

DEVELOPING DEVICE, IMAGE FORMING APPARATUS, AND PROCESS UNIT

CROSS-REFERENCE TO RELATED APPLICATIONS

The present application claims priority to and incorporates by reference the entire contents of Japanese priority document 2007-243277 filed in Japan on Sep. 20, 2007 and Japanese priority document 2007-285356 filed in Japan on Nov. 1, 2007.

BACKGROUND OF THE INVENTION

1. Field of the Invention

The present invention relates to a technology for detecting toner concentration in initial developer contained in a developing device by a toner-concentration detecting unit and consuming toner in developer in the developing device based on a detected result, to decrease the toner concentration in the initial developer.

2. Description of the Related Art

Conventionally, there are known image forming apparatuses such as copiers, printers, and facsimiles that develop a latent image on a latent-image carrier using developer containing toner and magnetic carrier. In this type of image forming apparatuses, toner concentration in a developer is generally maintained to a certain level by supplying toner into a developing device based on a result of detecting a decrease in the toner concentration in the developer due to development by a toner-concentration detecting sensor.

As for the image forming apparatus that maintains the toner concentration to the certain level in the above manner, a device that calibrates a toner-concentration detecting sensor in the following manner is disclosed in, for example, Japanese Patent Application Laid-open No. 2007-225813.

More specifically, an initial developer with toner concentration controlled to a predetermined toner concentration is set in a developing device when it is shipped from a factory. When the image forming apparatus is delivered to a user and power is initially turned on, the toner concentration in the initial developer is detected by the toner-concentration detecting sensor. A control voltage to be input to the toner-concentration detecting sensor is controlled so that an output voltage from the toner-concentration detecting sensor at this time is set to a predetermined value. In this manner, the toner-concentration detecting sensor is calibrated so that a voltage of a predetermined value with respect to the predetermined toner concentration is output.

A sensor formed of a magnetic permeability sensor that detects a magnetic permeability is generally used as the toner-concentration detecting sensor. FIG. 11 is a graph representing an example of a relationship between an output voltage Vt of the toner-concentration detecting sensor formed of the magnetic permeability sensor and toner concentration in developer. As shown in FIG. 11, the output voltage Vt of the toner-concentration detecting sensor decreases with an increase in the toner concentration in the developer. This is because the density of magnetic carrier per unit volume decreases with an increase in the toner concentration in the developer and the magnetic permeability of the developer thereby decreases. Because the slope of the graph or the sensitivity of the toner-concentration detecting sensor varies depending on products, the sensitivity is measured before shipping and the measured sensitivity is stored in an integrated circuit (IC) chip incorporated in a recent toner-concentration detecting sensor.

A case of using an initial developer in which toner concentration is controlled to 7% by weight will be explained below. The measurement of the sensitivity of the toner-concentration detecting sensor is implemented by measuring output voltages Vt when magnetic samples are detected, the magnetic samples obtaining magnetic permeabilities the same as respective magnetic permeabilities of developers containing three types of toners with standard loose apparent density at the rate of 4%, 7%, and 10% respectively.

By calibrating the toner-concentration detecting sensor in the above manner, for example, a graph with the sensitivity as shown in FIG. 12 stored in the built-in IC chip in the toner-concentration detecting sensor can be used. An output voltage Vt corresponding to 7 wt % being the toner concentration in the initial developer is determined, and 2.7 volts is obtained. This value coincides with the value when it is calibrated.

In the developing device right after the toner-concentration detecting sensor is calibrated, the developer corresponds an initial developer which means no toner is consumed, however, the toner concentration in the initial developer is not always a value suitable for subsequent development. Because even if the toner concentration in the developer is the predetermined value, the environment causes the image density to be different. Specifically, even if the developer is stirred in the developing device, a frictional charge amount of the toner cannot be increased satisfactorily under high-temperature and high-humidity environment. The charge amount (Q/M) per unit weight of toner thereby decreases more than an ordinary value, and a toner adhesion amount per predetermined unit area of a latent image that has a predetermined voltage increases.

Consequently, development of a latent image using the developer without changing the toner concentration in the initial developer may cause a large amount of toner to adhere to the latent image and the image density to be therefore higher than a target density. Conversely, the toner is excessively frictionally charged with stirring of the developer under low-temperature low-humidity environment, and only a small amount of toner is thereby caused to adhere to the latent image, so that the image density may be lower than the target density.

There is known an image forming apparatus that controls toner concentration in the initial developer in the following manner after the toner-concentration detecting sensor is calibrated. Specifically, first, a preset reference toner patch image is formed, and a toner adhesion amount (image density) per unit area of the reference toner patch image is detected by a reflective photosensor or the like. If the result of detection is lower than a target value (low image density), then toner is supplied into a developing device, and then a reference toner patch image is again formed. Thereafter, toner supply, formation of a reference toner patch image, and detection of a toner adhesion amount are repeated until the toner adhesion amount of the reference toner patch image reaches the target value.

On the other hand, if the toner adhesion amount of the reference toner patch image is higher than the target value (high image density), a solid toner image for forcible consumption of toner is formed and the toner in the initial developer is forcibly consumed, and then a reference toner patch image is formed again. Thereafter, formation of a solid toner image, formation of a reference toner patch image, and detection of a toner adhesion amount are repeated until the toner adhesion amount of the reference toner patch image reaches the target value.

By controlling the toner concentration in the initial developer in the above manner, development can be preformed using the developer with the toner concentration matching the environment, from a first sheet of initial prints.

The control of the toner concentration in the developer is generally performed in such a range that an output voltage Vt from the toner-concentration detecting sensor after being calibrated is not increased higher than a predetermined upper limit nor decreased lower than a predetermined lower limit. This is based on the reason as explained below. If the toner concentration is increased too high, a phenomenon called "background stains" is caused by the fact that toner is made to adhere to a background portion of a latent-image carrier. If the toner concentration is decreased too low, a phenomenon called "carrier adhesion" is caused by the fact that magnetic carrier of the developer in the developing device is made to adhere to the latent-image carrier. To prevent the background stains and the carrier adhesion, the output voltage Vt is maintained in the range from the lower limit to the upper limit. When the toner concentration in the initial developer is controlled in the above manner, the toner concentration is also controlled by maintaining the output voltage Vt in the range from the lower limit to the upper limit.

Referring to FIG. 12, "7-β" represents the lower limit of the toner concentration in the developer, and if the toner concentration decreases more than this, the carrier adhesion may be caused. A voltage corresponding to the lower limit of the toner concentration is an upper limit Vt1 of the output voltage Vt. Further, "7+α" represents the upper limit of the toner concentration in the initial developer, and if the toner concentration increases more than this, the background stains may be caused. A voltage corresponding to the upper limit of the toner concentration is a lower limit Vt2 of the output voltage Vt. The upper limit Vt1 and the lower limit Vt2 are stored in the built-in IC chip in the toner-concentration detecting sensor, together with the graph of FIG. 12 representing the sensitivity of the toner-concentration detecting sensor. By using the upper limit Vt1 and the lower limit Vt2 for controlling the toner concentration, it is possible to prevent the background stains and the carrier adhesion.

However, it is found that even if the upper limit Vt1 is used, the carrier adhesion may be caused upon initial printing due to variation in a loose apparent density of toner contained in the initial developer, and that the carrier adhesion may damage the latent-image carrier such as a photosensitive element.

The reason is explained below.

Generally, even if toner is manufactured in the same method and under the same environment, a loose apparent density (volume per unit mass) of the toner varies with each product. Meanwhile, the toner-concentration detecting sensor formed of the magnetic permeability sensor does not detect the toner concentration itself in the developer but detects carrier density in the developer (bulk density of developer). Even if the toner concentration in the developer (a weight ratio of toner to magnetic carrier) is constant, the carrier density in the developer may become different if the loose apparent density of toner is different. Therefore, even if the developer with the same toner concentration is used, an output value from the toner-concentration detecting sensor becomes different if the loose apparent density of toner is different.

The slope of the graph for sensitivity shown in FIG. 12 represents a case where toner with a standard loose apparent density is used, and thus the loose apparent density of toner actually contained in the initial developer is not always a standard value. If the loose apparent density of toner in the initial developer is higher than the standard value, or if the volume of toner per unit mass is comparatively small, a more gentle slope indicated by the solid line as shown in FIG. 13 is formed in the graph of the output voltage Vt of the toner-concentration detecting sensor that uses the initial developer as an object to be detected. When the loose apparent density of the toner is high, a change in the volume of the toner in the developer becomes comparatively small caused by a change in toner concentration, and a rate of change of the magnetic permeability with respect to the change in the toner concentration becomes thereby comparatively small.

In this case, the upper limit Vt1 of the output voltage Vt stored in the toner-concentration detecting sensor is "7-β-γ" lower than "7-β" which is the lower limit of the toner concentration in the graph indicated by the solid line of FIG. 13. Specifically, despite setting the output voltage Vt to be lower than the upper limit Vt1, the toner concentration becomes lower than the lower limit. This causes the carrier adhesion.

When a two-component developer is used to repeatedly develop an electrostatic latent image, toner in the developer is consumed and the toner concentration thereby fluctuates. Therefore, to obtain stable images upon printing, it is necessary to supply toner as required and minimize the fluctuation. Generally, when a toner supply amount is controlled, an image forming apparatus such as a copier includes a permeability detecting sensor, a flowability detecting sensor, an image-density detecting sensor, a bulk-density detecting sensor, and a like. A recent mainstream of these sensors is to use the image-density detecting sensor or a combination of the image-density detecting sensor and the magnetic permeability sensor (a type of bulk-density sensor). The control of the toner concentration using the image-density detecting sensor is performed by a system of controlling a toner supply amount by developing a fixed image pattern on the image carrier and detecting an image density from the reflected light. The control of the toner concentration using the combination of the image-density detecting sensor and the magnetic permeability sensor is performed by a system of controlling a toner supply amount by changing a target value of the magnetic permeability sensor based on the density of an image pattern.

An invention disclosed in Japanese Patent Application Laid-open No. 2005-346102 has less fluctuation in the bulk density of developer and can thereby stably control the toner concentration even when the developer is used under high stress, and, therefore, has solved such a defect that the toner concentration is unstably controlled caused by fluctuation in the bulk density of the developer when the developer is used under high stress.

However, there are some problems as follows in controlling an output of the initial developer of the magnetic permeability sensor.

An output of the magnetic permeability sensor for the initial developer is generally controlled based on reference toner concentration. Therefore, in a case of other toner concentrations, an output is calculated from a relationship between an output of the magnetic permeability sensor based on the reference toner concentration and toner concentration. However, the output of the magnetic permeability sensor has such a property that the output decreases as carrier being a magnetic body is far from the magnetic permeability sensor or as carrier particles are sparsely distributed. Consequently, if the carrier particles separate from the upper portion of the toner-concentration detecting sensor due to the decrease in the bulk density of the developer or are sparsely distributed, this results in an erroneous detection that the output decreases and the toner concentration increases, although the toner concentration is not changed. Conversely, if the carrier particles become dense in the upper portion of the toner-concentration detecting sensor because of an increase in the bulk density of the developer, this results in an erroneous detection that the output increases and the toner concentration decreases, although the toner concentration is not changed.

This is because the bulk density of carrier in the developer is different depending on variation due to its manufacture and the bulk density in the developer varies to make different the state of the carrier particles in the upper portion of the toner-concentration detecting sensor. To minimize the variation, the output of the toner-concentration detecting sensor is controlled and corrected using the initial developer based on the same toner concentration. As a factor that the erroneous detection occurs with the magnetic permeability sensor, a relationship between the output of the magnetic permeability sensor and the toner concentration is the same when the reference toner concentration is used, but the relationship between the two is different when the toner concentration changes.

Because the toner concentration changes due to the environment and the use pattern, appropriate toner concentration needs to be provided for the developing device. This is because toner scattering or background stains may occur if the toner concentration becomes too high while an image is formed abnormally due to insufficient supply of the developer if the toner concentration becomes too low. The upper limit and the lower limit of the toner concentration are controlled by an output value of the toner-concentration detecting sensor not to cause these defects.

However, the variation cannot be suppressed satisfactorily only by controlling the output of the toner-concentration detecting sensor when the initial developer is used because the upper and lower limits of the toner concentration to be controlled are different depending on the bulk density of the carrier in the initial developer. Because of this, if the upper limit of the toner concentration becomes high, toner scattering or background stains may occur, or the image density may be insufficient if the upper limit thereof becomes low.

If the lower limit of the toner concentration becomes high, the toner concentration cannot be decreased, so that the image density may be too high. If the lower limit of the toner concentration becomes low, the bulk of the developer becomes too low, so that the developer is unstably sucked up to a developing element to cause an image to be abnormal.

Besides, the invention disclosed in Japanese Patent Application Laid-open No. 2005-346102 does not mention about defects that the upper and lower limits of the toner concentration are unstably controlled caused by fluctuation in the bulk density of the developer due to a difference in bulk density of carriers in initial developers.

SUMMARY OF THE INVENTION

It is an object of the present invention to at least partially solve the problems in the conventional technology.

According to one aspect of the present invention, there is provided a developing device including a developer container that contains developer including toner and carrier; a toner-concentration detecting unit that detects toner concentration of the developer in the developer container; a developer carrier that carries the developer in the developer container on its surface and develops a latent image on a latent-image carrier with the developer; an information attaching unit that attaches either one of carrier density information of initial developer, which is new developer set in the developing device, and loose apparent density information of toner in the initial developer to a housing of the developing device; and a density-information storage unit that stores therein either one of the carrier density information and the loose apparent density information as electronic data. At least one of the information attaching unit and the density-information storage unit is provided before shipment of the developing device.

Furthermore, according to another aspect of the present invention, there is provided a process unit including at least a latent-image carrier and a developing device held by a common holder, which is integrally formed into one unit to be attached in a detachable manner to a main body of an image forming apparatus. The developing device includes a developer container that contains developer including toner and carrier, a toner-concentration detecting unit that detects toner concentration of the developer in the developer container, a developer carrier that carries the developer in the developer container on its surface and develops a latent image on a latent-image carrier with the developer, an information attaching unit that attaches either one of carrier density information of initial developer, which is new developer set in the developing device, and loose apparent density information of toner in the initial developer to a housing of the developing device, and a density-information storage unit that stores therein either one of the carrier density information and the loose apparent density information as electronic data. At least one of the information attaching unit and the density-information storage unit is provided before shipment of the developing device The above and other objects, features, advantages and technical and industrial significance of this invention will be better understood by reading the following detailed description of presently preferred embodiments of the invention, when considered in connection with the accompanying drawings.

DESCRIPTION OF THE PREFERRED EMBODIMENTS

Exemplary embodiments of the present invention are explained in detail below with reference to the accompanying drawings.

One embodiment of an electrophotographic copier as an image forming apparatus applied with the present invention will be explained below.

Figure 1:
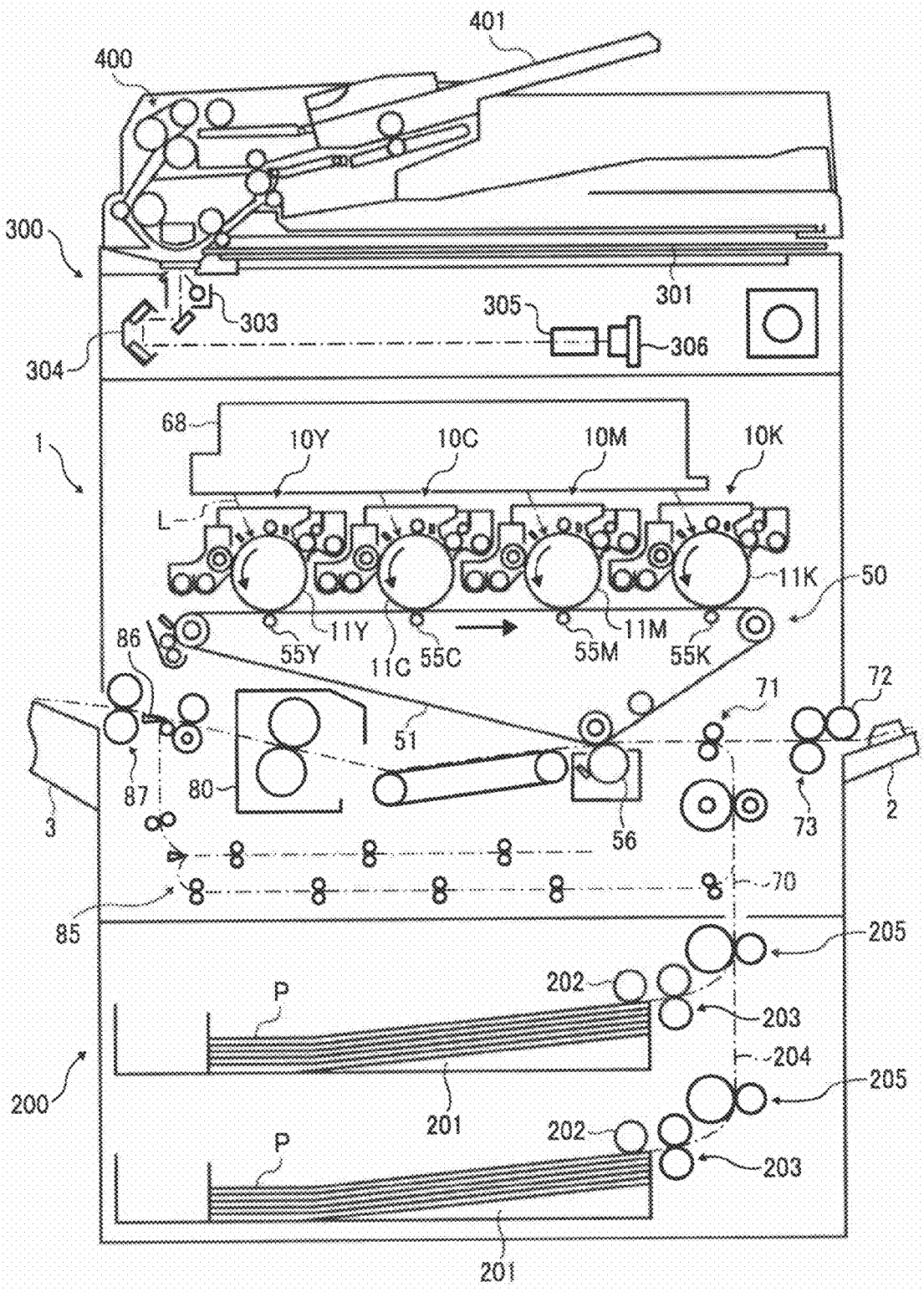
FIG. 1 is a schematic for explaining a copier according to a first embodiment of the present invention.

FIG. 1 is a schematic for explaining a copier according to a first embodiment of the present invention. The copier includes a printer unit 1 that forms an image on a recording paper, a paper feed device 200 that supplies a recording paper P to the printer unit 1, a scanner 300 that scans an image of an original, and an automatic document feeder (ADF) 400 that automatically feeds the original to the scanner 300.

The scanner 300 includes a first carriage 303 that incorporates a light source for illumination of an original and a mirror, and a second carriage 304 that incorporates a plurality of reflective mirrors. In the scanner 300, an original (not shown) set on a contact glass 301 is scanned in association with reciprocating movements of the first carriage 303 and the second carriage 304. A scanning light output from the second carriage 304 is collected by an imaging lens 305 to an image plane of a reading sensor 306 provided in the downstream side of the imaging lens 305, and then the original is read as an image signal by the reading sensor 306.

Provided on the side face of a housing of the printer unit 1 are a manual feed tray 2 on which a recording paper P to be fed into the housing is manually set and a paper discharge tray 3 on which the recording paper P with the image formed thereon discharged from the housing is stacked.

Figure 2:
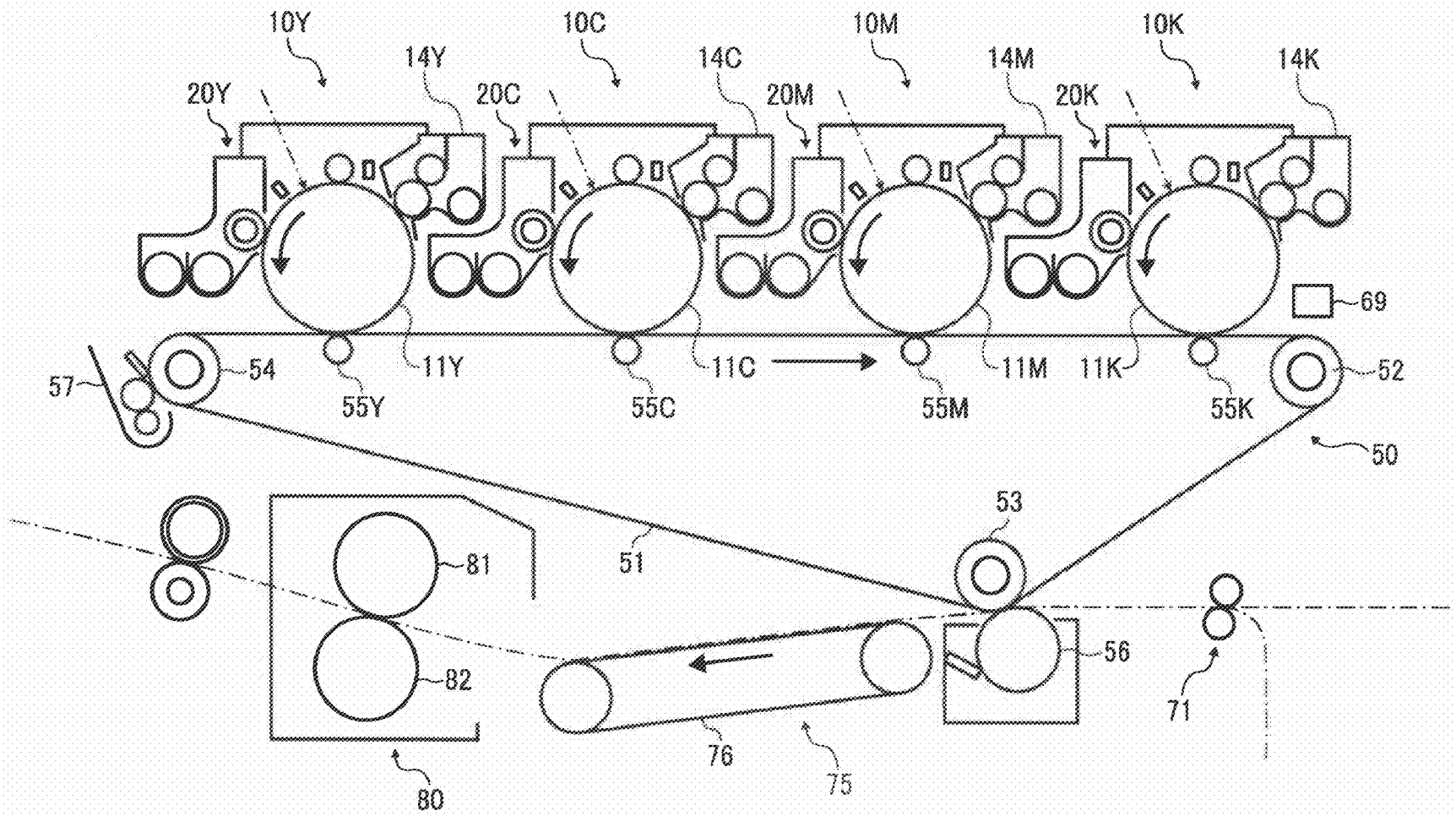
FIG. 2 is an enlarged schematic diagram for explaining a part of an internal configuration of a printer unit in the copier.

FIG. 2 is an enlarged schematic diagram for explaining a part of an internal configuration of the printer unit 1. A transfer unit 50 is arranged in the housing of the printer unit 1. The transfer unit 50 includes a plurality of tension rollers that stretch an endless-type intermediate transfer belt 51 as an image carrier. The intermediate transfer belt 51 is stretched by a driving roller 52 that is made to rotate in the clockwise in FIG. 2 by a drive unit (not shown), a secondary-transfer backup roller 53, a driven roller 54, and four primary transfer rollers 55Y, 55C, 55M, and 55K, and is made to endlessly move in the clockwise in FIG. 2 by rotation of the driving roller 52. It is rioted that the additional characters Y, C, M, and K added to the ends of the reference numerals of the primary transfer rollers indicate elements for yellow, cyan, magenta, and black respectively. Hereinafter, the same goes to the additional characters Y, C, M, and K added to the ends of other reference numerals.

The intermediate transfer belt 51 is largely bent at portions where it is wound around the driving roller 52, the secondary-transfer backup roller 53, and the driven roller 54, and this causes the intermediate transfer belt 51 to be stretched in an inverted triangular posture with its base upward in the vertical direction. The upper-side stretched surface of the belt being the base of the inverted triangle is extended in the horizontal direction, and above the upper-side stretched surface, four process units 10Y, 10C, 10M, and 10K are arranged serially in the horizontal direction along the extending direction of the upper-side stretched surface.

Referring back to FIG. 1, an optical writing unit 68 is disposed above the four process units 10Y, 10C, 10M, and 10K. The optical writing unit 68 drives four semiconductor lasers (not shown) by a laser controller (not shown) to emit four writing lasers L based on the image information of the original read by the scanner 300. Drum-shaped photosensitive elements 11Y, 11C, 11M, and 11K being latent-image carriers of the process units 10Y, 10C, 10M, and 10K are scanned in the dark with the writing lasers L respectively, so that electrostatic latent images for Y, C, M, and K are written in the surfaces of the photosensitive elements 11Y, 11C, 11M, and 11K, respectively.

The first embodiment uses the optical writing unit 68 that performs optical scanning by reflecting a laser beam emitted from the semiconductor laser on a reflective mirror (not shown) or passing it through an optical lens while deflecting the laser beam by a polygon mirror (not shown). Any optical writing unit that performs optical scanning by a light emitting diode (LED) array may be used instead of the above-mentioned configuration.

Figure 3:
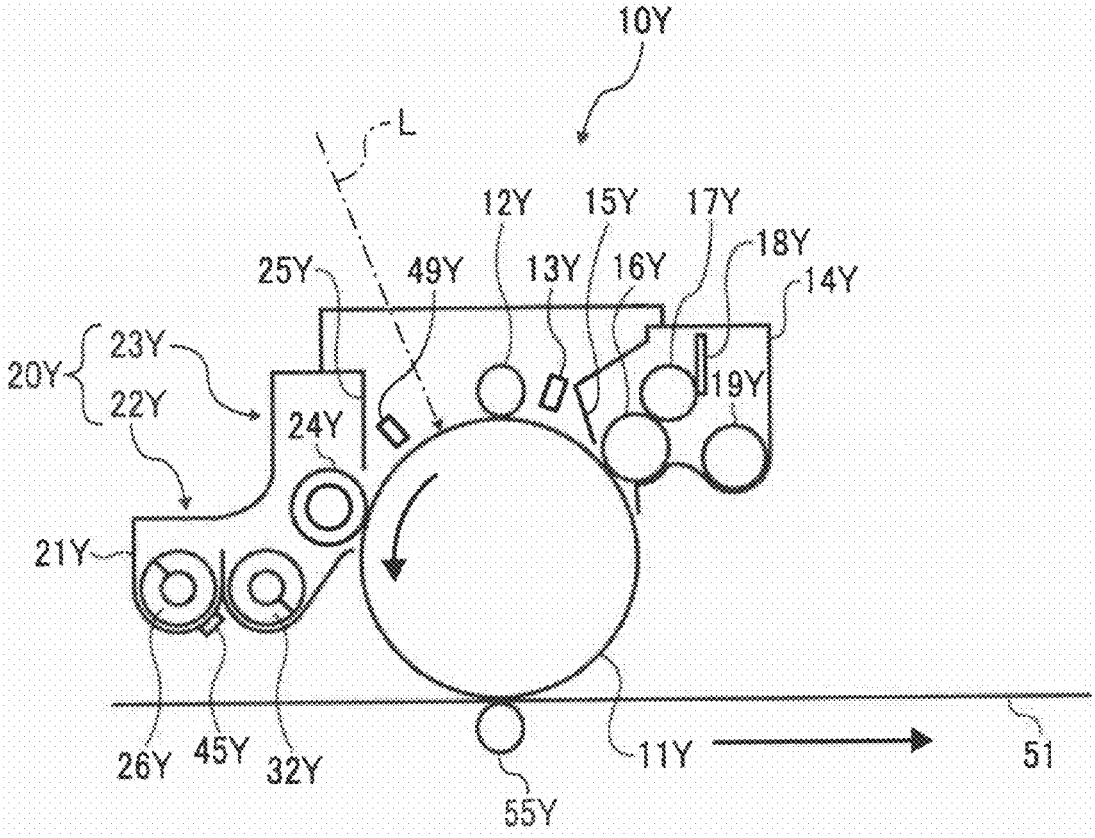
FIG. 3 is a schematic for explaining a process unit for Y color in the printer unit together with an intermediate transfer belt.

FIG. 3 is an enlarged schematic diagram for explaining the process unit 10Y together with the intermediate transfer belt 51. The process unit 10Y includes a charging element 12Y, a decharging device 13Y, a drum cleaning device 14Y, a developing device 20Y being a developing unit, and a potential sensor 49Y, which are arranged around a photosensitive element 11Y. These components are held by a casing as a common holder to be integrally formed into one unit, and the one unit is attached/detached to/from the printer unit.

The charging element 12Y is a roller element rotatably supported by a bearing (not shown) while being in contact with the photosensitive element 11Y. The roller element rotatably contacts the photosensitive element 11Y while being applied with a charging bias by a bias applying unit (not shown), and this causes the surface of the photosensitive element 11Y to be uniformly charged to the same polarity as a charged polarity of, for example, Y toner. A scorotron charger or the like may also be used instead of the charging element 12Y configured in the above manner. The scorotron charger subjects the photosensitive element 11Y to a uniform charging process in a noncontact manner.

The developing device 20Y includes a Y developer containing magnetic carrier and nonmagnetic Y toner (not shown) in a casing 21Y, and further includes a developer conveying device 22Y and a developing unit 23Y. In the developing unit 23Y, a developing sleeve 24Y being a developer carrier is made to rotate by a drive unit (not shown) so that a part of the periphery thereof whose surface is endlessly moved is exposed to the outside from an opening provided in the casing 21Y. Consequently, a developing area, where the photosensitive element 11Y and the developing sleeve 24Y face each other with a predetermined space therebetween, is formed.

A magnet roller (not shown) including a plurality of magnetic poles arranged in its circumferential direction is fixed to an inner side of the developing sleeve 24Y formed of a nonmagnetic hollow-piped element so that the magnet roller does not rotate following the developing sleeve 24Y. The developing sleeve 24Y is made to rotate while attracting the Y developer in the developer conveying device 22Y explained later to the surface by magnetic force generated by the magnet roller, and the Y developer is thereby sucked from the developer conveying device 22Y. The Y developer conveyed toward the developing area with the rotation of the developing sleeve 24Y enters a doctor gap formed between a doctor blade 25Y and the surface of the developing sleeve 24Y, the edge of the doctor blade 25Y facing the surface of the developing sleeve 24Y with a predetermined gap therebetween. At this time, a layer thickness on the sleeve is controlled to almost the same as the doctor gap. The Y developer is conveyed with the rotation of the developing sleeve 24Y up to near the developing area facing the photosensitive element 11, and toner chains are formed on the sleeve due to the magnetic force of the developing magnetic poles (not shown) in the magnet roller, to form magnetic brushes with the toner.

Applied to the developing sleeve 24Y is a developing bias with the same polarity as, for example, the charged polarity of the toner by the bias applying unit (not shown) Consequently, in the developing area, a non-developing potential that causes the Y toner to electrostatically move from a non-image portion (uniformly charged portion i.e., background portion) of the photosensitive element 11Y to the sleeve side acts between the surface of the developing sleeve 24Y and the non-image portion. Further, a developing potential that causes the Y toner to electrostatically move from the sleeve side to an electrostatic latent image acts between the surface of the developing sleeve 24Y and the electrostatic latent image on the photosensitive element 11Y. The Y toner in the Y developer transfers to the electrostatic latent image by the action of the developing potential, and the electrostatic latent image on the photosensitive element 11Y is thereby developed.

The Y developer having passed through the developing area with the rotation of the developing sleeve 24Y separates from the developing sleeve 24Y affected by a repelling magnetic field formed between repelling magnetic poles provided in the magnet roller (not shown), to be returned into the developer conveying device 22Y.

The developer conveying device 22Y includes two screw elements such as a first screw element 26Y and a second screw element 32Y, a partition wall provided between the both screw elements, and a toner-concentration detecting sensor 45Y formed of the magnetic permeability sensor. The partition wall partitions a first conveying chamber being a developer conveying unit that contains the first screw element 26Y from a second conveying chamber being a developer conveying unit that contains the second screw element 32Y. However, the both conveying chambers are made to communicate each other through an opening (not shown) in an area that faces both ends of the screw elements in the axial direction.

Each of the first screw element 26Y and the second screw element 32Y being stirring-conveying elements includes a rod-shaped rotating shaft element of which both ends are rotatably supported by bearings (not shown) and a spiral blade spirally protruded around its peripheral surface. The stirring-conveying element conveys the Y developer by the spiral blade in a rotating axis direction with rotation driven by the drive unit (not shown).

In the first conveying chamber containing the first screw element 26Y, the Y developer is conveyed from this side perpendicularly to the paper surface of FIG. 3 toward the other side with the rotation of the first screw element 26Y. The Y developer is conveyed up to near the other end of the first screw element 26Y in the casing 21Y, and enters the second conveying chamber through the opening (not shown) provided on the partition wall.

The developing unit 23Y is formed above the second conveying chamber that contains the second screw element 32Y, and the second conveying chamber and the developing unit 23Y communicates each other along entire area of a mutually opposed portion. With this feature, the second screw element 32Y and the developing sleeve 24Y provided obliquely upward of the second screw element 32Y face each other while maintaining a mutually parallel relationship. In the second conveying chamber, the Y developer is conveyed from the other side perpendicularly to the paper surface of FIG. 3 toward this side with the rotation of the second screw element 32Y. During the conveying process, the Y developer around the second screw element 32Y in the rotational direction is appropriately sucked up to the developing sleeve 24Y or the Y developer after being used for developing is appropriately collected from the developing sleeve 24Y. The Y developer conveyed up to near the end in this side of FIG. 3 in the second conveying chamber is returned into the first conveying chamber through the opening (not shown) provided on the partition wall.

Fixed to the lower wall of the first conveying chamber is the toner-concentration detecting sensor 45Y as a toner-concentration detecting unit formed of the magnetic permeability sensor, and the toner concentration in the Y developer conveyed by the first screw element 26Y is detected from the lower side, and a voltage corresponding to the result of detection is output. A controller (not shown) drives a Y toner supply device (not shown) if needed and supplies an appropriate amount of the Y toner to the first conveying chamber based on the output voltage from the toner-concentration detecting sensor 45Y. Accordingly, the toner concentration in the Y developer in which the toner concentration has been decreased due to developing is recovered.

The Y toner image formed on the photosensitive element 11Y is primarily transferred to the intermediate transfer belt 51 at a primary transfer nip for Y explained later. After passing through a primarily transfer process, residual toner not having been primarily transferred to the intermediate transfer belt 51 adheres to the surface of the photosensitive element 11Y as "remaining toner after transfer".

The drum cleaning device 14Y supports a cleaning blade 15Y formed of, for example, polyurethane rubber in a cantilever manner, and causes the free end of the cleaning blade 15Y to come in contact with the surface of the photosensitive element 11Y. The brush tip side of a brush roller 16Y is made in contact with the photosensitive element 11Y, the brush roller 16Y being formed of a rotating shaft element rotated by the drive unit (not shown) and of a large number of conductive bristles provided outwardly around the peripheral surface of the rotating shaft element. The residual toner after transfer is scraped off from the surface of the photosensitive element 11Y by the cleaning blade 15Y and the brush roller 16Y. The brush roller 16Y is applied with a cleaning bias via a metallic electric-field roller 17Y in contact with the brush roller 16Y. An edge of a scraper 18Y is pressed on the electric-field roller 17Y.

The residual toner after transfer scraped off from the photosensitive element by the cleaning blade 15Y and the brush roller 16Y passes through the brush roller 16Y and the electric-field roller 17Y, and then the residual toner after transfer is further scraped off from the electric-field roller 17Y by the scraper 18Y, to drop onto a collecting screw 19Y. Then, the residual toner after transfer is ejected to the outside of the casing with the rotation of the collecting screw 19Y, and returned into the developer conveying device 22Y via a recycled-toner conveying unit (not shown).

The surface of the photosensitive element 11Y from which the residual toner after transfer is cleaned by the drum cleaning device 14Y is decharged by the decharging device 13Y formed of a decharging lamp and the like, and is uniformly charged again by the charging element 12Y.

A potential of the non-image portion of the photosensitive element 11Y having passed through a position of optical writing using a writing light L is detected by the potential sensor 49Y, and the result of the detection is sent to the controller (not shown).

The details of the process unit 10Y are explained, however, the process units for the other colors (10C, 10M, and 10K) have the same configuration as that for Y, except for colors of toner to be used.

Referring back to FIG. 2, the photosensitive elements 11Y, 11C, 11M, and 11K of the process units 10Y, 10C, 10M, and 10K rotate while being in contact with the upper-side stretched surface of the intermediate transfer belt 51 which is caused to endlessly move in the clockwise, to form primary transfer nips for Y, C, M, and K respectively. The primary transfer rollers 55Y, 55C, 55M, and 55K contact the backside of the intermediate transfer belt 51 at respective backsides of the primary transfer nips for Y, C, M, and K. These primary transfer rollers 55Y, 55C, 55M, and 55K are applied with the primary transfer bias with reverse polarity to the charged polarity of toner by the bias applying units (not shown) respectively. The primary transfer bias causes primary-transfer electric fields to form at the primary transfer nips for Y, C, M, and K respectively so that each toner is electrostatically moved from the photosensitive element to the belt.

Y, C, M, and K toner images formed on the photosensitive elements 11Y, 11C, 11M, and 11K enter the primary transfer nips for Y, C, M, and K respectively with the rotation of the photosensitive elements 11Y, 11C, 11M, and 11K, and are primarily transferred to the intermediate transfer belt 51 in the superimposed manner by the actions of the primary-transfer electric fields and nip pressure. With this feature, four-color superimposed toner images (hereinafter, "four-color toner images") are formed on the top surface (outer peripheral surface of a loop) of the intermediate transfer belt 51. A conductive brush applied with a primary transfer bias or a non-contact type corona charger may be used instead of the primary transfer rollers 55Y, 55C, 55M, and 55K.

An optical sensor unit 69 is disposed in the right side of the process unit 11K in FIG. 2 so as to face the top surface of the intermediate transfer belt 51 via a predetermined gap. The optical sensor unit 69 outputs a voltage corresponding to a toner adhesion amount per unit area of a reference toner patch image, explained later, transferred to the intermediate transfer belt 51.

A secondary transfer roller 56 is disposed below the intermediate transfer belt 51, and is in contact with the top surface of the intermediate transfer belt 51 while being driven to rotate in the counterclockwise of FIG. 2 by a drive unit (not shown), to form a secondary transfer nip. The intermediate transfer belt 51 is wound around the secondary-transfer backup roller 53 in the backside of the secondary transfer nip.

Applied to the secondary-transfer backup roller 53 is a secondary transfer bias with the same polarity as the charged polarity of the toner by a secondary-transfer power supply (not shown). Meanwhile, the secondary transfer roller 56, being a contact element that contacts the top surface of the belt to form the secondary transfer nip, is grounded. With this feature, a secondary-transfer electric field is formed between the secondary-transfer backup roller 53 and the secondary transfer roller 56. The four-color toner images formed on the top surface of the intermediate transfer belt 51 enter the secondary transfer nip with the endless movement of the intermediate transfer belt 51.

Referring back to FIG. 1, the paper feed device 200 includes a paper feed cassette 201 that stores sheets of recording paper P, a paper feed roller 202 that feeds the stored recording paper P to the outside of the cassette, a separation roller pair 203 that separates the fed-out sheets of recording paper P one by one, and a conveying roller pair 205 that conveys the separated recording paper P along a feed-out path 204, these components being provided in plurality. The paper feed device 200 is arranged right below the printer unit 1 as shown in FIG. 1. The feed-out path 204 of the paper feed device 200 is connected to a paper feed path 70 of the printer unit 1. Consequently, the recording paper P fed out from the paper feed cassette 201 is sent into the paper feed path 70 via the feed-out path 204.

A registration roller pair 71 being a paper feeding unit is arranged near the end of the paper feed path 70, and the recording paper held by rollers of the registration roller pair 71 is fed into the secondary transfer nip by matching the timing of synchronization of the recording paper P with the four-color toner images on the intermediate transfer belt 51. In the secondary transfer nip, the four-color toner images on the intermediate transfer belt 51 are collectively, secondarily transferred to the recording paper P due to the secondary-transfer electric field and the nip pressure, to form a full color image with white color of the recording paper P. The recording paper P with the full color image formed thereon in the above manner is discharged from the secondary transfer nip and is separated from the intermediate transfer belt 51.

Arranged in the left side of the secondary transfer nip in FIG. 2 is a conveyor belt unit 75 that endlessly moves an endless paper conveyor belt 76 in the counterclockwise in FIG. 2 while being supported by a plurality of stretching rollers. The recording paper P separated from the intermediate transfer belt 51 is transferred to the upper-side stretched surface of the paper conveyor belt 76, to be conveyed toward a fixing device 80.

The recording paper P sent to the fixing device 80 is held at a fixing nip formed by a heating roller 81 that contains a heat source (not shown) such as a halogen heater and by a pressing roller 82 pressed against the heating roller 81. The recording paper P is sent toward the outside of the fixing device 80 while the full color image is fixed on the surface thereof by being pressed and heated.

A slight amount of residual toner that has not been transferred to the recording paper P upon secondary transfer adheres as "residual toner after secondary transfer" to the surface of the intermediate transfer belt 51 after passing through the secondary transfer nip. The residual toner after secondary transfer is removed from the intermediate transfer belt 51 by a belt cleaning device 57 that is in contact with the top surface of the intermediate transfer belt 51.

A switch-back device 85 is arranged below the fixing device 80. The recording paper P discharged from the fixing device 80 reaches a conveying-path switching position switched by a swingable switch claw 86, and is sent toward a paper discharge roller pair 87 or toward the switch-back device 85 according to a swing stop position of the switch claw 86. When the recording paper P is sent toward the paper discharge roller pair 87, the recording paper P is discharged to the outside of the machine and stacked on the paper discharge tray 3.

Meanwhile, when the recording paper P is sent toward the switch-back device 85, the recording paper P is turned upside down through switch-back conveyance by the switch-back device 85 and is again conveyed toward the registration roller pair 71. Then, the recording paper P again enters the secondary transfer nip and a full color image is formed on the other side of the paper.

The recording paper P manually fed to the manual feed tray 2 provided on the side face of the housing of the printer unit 1 is sent toward the registration roller pair 71 after passing through a manual paper feed roller 72 and a manually-fed-paper separation roller pair 73.

When an original is to be copied by the copier according to the first embodiment, first, an original is set on a document tray 401 of the ADF 400. Alternatively, the ADF 400 is opened and an original is set on the contact glass 301 of the scanner 300, and the ADF 400 is closed and pressed on the original. Thereafter, when the original is set on the ADF 400, a start switch (not shown) is pressed and the original is then sent into the contact glass 301. The scanner 300 is driven so that the first carriage 303 and the second carriage 304 start scanning the original. The transfer unit 50 and the process units 10Y, 10C, 10M, and 10K start to be driven almost simultaneously with the start of the scanning. Further, the recording paper P starts to be fed out from the paper feed device 200. If a recording paper P not set in the paper feed cassette 201 is used, a recording paper P set on the manual feed tray 2 is fed out.

A controller (see FIG. 4) being a control unit in the printer unit 1 of the copier includes a central processing unit (CPU), a read only memory (ROM) being a data storage unit that stores therein control programs and parameters, a random access memory (RAM), and an input-output (I/O) interface. The devices in the printer unit 1 are controlled based on the stored control programs.

A toner patch pattern for K color is formed at one end of the intermediate transfer belt 51 in the width direction at a predetermined timing. The toner patch pattern for K color is formed of a plurality of K reference toner patch images mutually arranged in a predetermined interval in the direction of movement of the intermediate transfer belt 51. Toner patch patterns for Y, M, and C colors are formed at the other end of the intermediate transfer belt 51 in the width direction at a predetermined timing. Each of these toner patch patterns for Y, M, or C colors is formed of a plurality of toner patch images mutually arranged in a predetermined interval in the direction of movement of the intermediate transfer belt 51. In the present copier, each of the toner patch patterns contains seven reference toner patch images, however, the number of the reference toner patch images that form the toner patch pattern may be more or less than seven. It is noted that three Y, M, and C colors are collectively called chromatic colors.

The optical sensor unit 69 shown in FIG. 2 includes a first optical sensor, disposed at one end of the intermediate transfer belt 51 in the width direction, formed of a light emitting element (not shown) that emits light toward the surface of the belt and of a regularly-reflected-light receiving element (not shown) that receives regularly reflected light being regularly reflected on the surface of the belt. The optical sensor unit 69 also includes a second optical sensor, disposed at the other end of the intermediate transfer belt 51 in the width direction, formed of a light emitting element (not shown) that emits light toward the surface of the belt and of a diffused-light receiving element (not shown) that receives diffusively reflected light being diffusively reflected on the surface of the belt.

Individual K reference toner patch images within the toner patch pattern for K color formed at one end of the intermediate transfer belt 51 move up to right under the first optical sensor of the optical sensor unit 69 with endless movement of the belt, and an output voltage from the first optical sensor thereby significantly drops. This is because the light emitted from the light emitting element is blocked by a K toner layer of the K reference toner patch image, so that the light is hardly regularly reflected on the surface of the belt. The output voltage from the first optical sensor at this time is a value corresponding to a K toner adhesion amount (K image density) per unit area of the K reference toner patch image. The controller can determine the K toner adhesion amount of the K reference toner patch image based on the output voltage from the first optical sensor.

The Y, M, and C reference toner patch images within the toner patch patterns for the chromatic colors respectively formed at the other end of the intermediate transfer belt 51 move up to right under the second optical sensor of the optical sensor unit 69 with endless movement of the belt, and an output voltage from the second optical sensor thereby significantly rises. This is because the light emitted from the light emitting element of the second optical sensor is diffusively reflected on each of Y, M, and C toner layers of the Y, M, and C reference toner patch images, so that the light is received as diffusively reflected light by the diffused-light receiving element. The output voltages from the second optical sensor at this time are values corresponding to Y, M, and C toner adhesion amounts (Y, M, C image densities) per unit area of the Y, M, and C reference toner patch images, respectively. The controller can determine the Y, M, and C toner adhesion amounts of the Y, M, and C reference toner patch images respectively based on the output voltages from the second optical sensor.

The printer unit 1 includes toner supply devices for Y, M, C, and K (not shown) that individually supply Y, M, C, and K toners to the developing devices 20Y, 20M, 20C, and 20K in the process units 10Y, 10M, 10C, and 10K respectively. Furthermore, Y, M, C, and K toner cartridges (not shown) that individually contain Y, M, C, and K toners to be supplied are detachably provided in the printer unit 1.

The developing devices 20Y, 20M, 20C, and 20K include toner-concentration detecting sensors for Y, M, C, and K, respectively, formed of magnetic permeability sensors that detect Y, M, C, and K toner image of Y, M, C, and K developers contained in the developing devices 20Y, 20M, 20C, and 20K respectively. The controller stores Y-Vtref, M-Vtref, C-Vtref, and K-Vtref being target values, in a ROM, for controlling outputs of the toner-concentration detecting sensors for Y, M, C, and K respectively. The controller controls each drive of the Y, M, C, and K toner supply devices based on these values Vtref and output voltages Vt from the Y, M, C, and K toner-concentration detecting sensors.

More specifically, when the toner concentration in the developer decreases due to consumption of toner in the developer caused by the developing operation, an output voltage from the toner-concentration detecting sensor increases. The controller, therefore, calculates ΔT (Vtref-Vt) which is a difference between Vtref and an output voltage Vt from the toner-concentration detecting sensor at a predetermined timing. If the result of calculation is a positive value, this means that the toner concentration in the developer is sufficiently high, and thus the toner supply device is not driven. If ΔT is a negative value, the toner supply device is driven only for a time corresponding to the value, and thus the toner concentration in the developer is recovered to a predetermined control target value.

A characteristic configuration of the copier as the image forming apparatus according to the present invention will be explained below.

Figure 4:
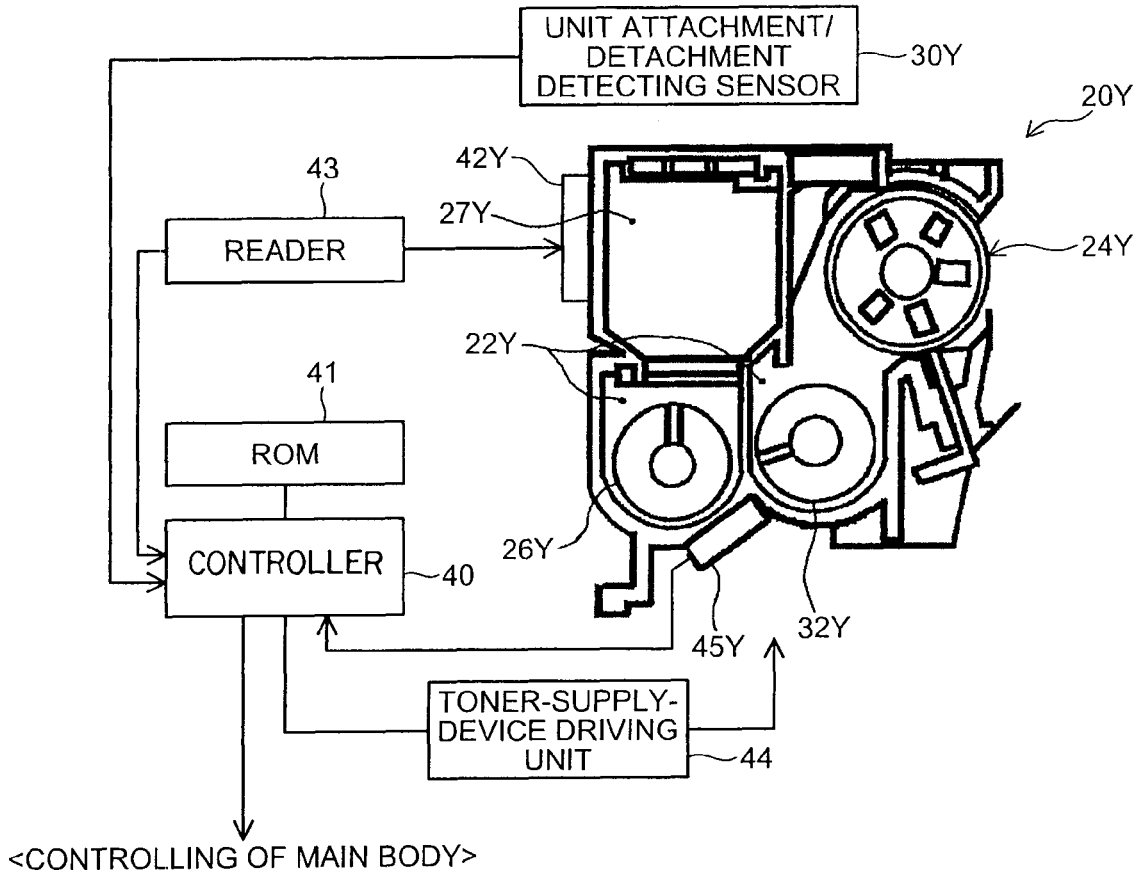
FIG. 4 is a schematic for explaining a developing device in the process unit and a control system.

FIG. 4 is an enlarged schematic diagram for explaining the developing device 20Y.

In FIG. 4, reference numeral 40 represents the controller, 41 a ROM (which may be provided in a controller 40), 42Y a nonvolatile RAM, 43 a reader, and 44 a toner-supply-device driving unit. These operations will be explained later. Although the developing device for Y color is shown here, the components being the nonvolatile RAM, the reader, and the toner-supply-device driving unit are also provided in the developing devices for C, M, and K colors. Therefore, the developing device for Y color is explained below as an example thereof.

The developing device 20Y includes an initial-developer container 27Y that contains Y-color initial developer above the developer conveying device 22Y although it is omitted in FIG. 3 for simplicity in explanation. The initial-developer container 27Y and the developer conveying device 22Y communicate each other through an opening for inputting the initial developer. However, in the developing device 20Y in an initial state, the opening is closed with a sealing seal (not shown). Before attaching a new process unit 10Y to the printer unit 1, a user pulls out the sealing seal from the developing device 20Y, to cause the initial-developer container 27Y and the developer conveying device 22Y to communicate each other. This allows falling of the initial developer caused by gravity from the initial-developer container 27Y into the developer conveying device 22Y.

It is previously recognized from tests conducted by the toner manufacturer that all the Y, M, C, and K toners used in the present printer vary in a range of a loose apparent density from 0.38÷0.04 g/cm$^3$ for each product. Namely, a standard value of the loose apparent density of toner is 0.38 g/cm$^3$. The loose apparent density is measured in the following manner. Specifically, 10 grams of toner is input into a 50-milliliter female cylinder, and then the female cylinder is closed and shaken 50 times. Thereafter, the female cylinder is opened and is left standing for 10 minutes, then a scale is read, and a ratio of the read scale to a measured toner amount is calculated, to determine a loose apparent density.

Referring back to FIG. 2, the toner-concentration detecting sensors of the developing devices 20Y, 20M, 20C, and 20K have IC chips (not shown) respectively, and each IC chip stores therein sensitivity information about the toner-concentration detecting sensor so as to be machine-readable. The sensitivity information is a function representing a graph of a rate of change of an output voltage Vt due to a change of a magnetic permeability. The function is constructed for each sensor product based on the results of actually detecting output voltages Vt with respect to three magnetic samples having the same magnetic permeabilities as those of developers containing toner with a concentration of 4 wt %, 7 wt %, and 10 wt %, the loose apparent density of the toner being 0.38 g/cm$^3$ which is the standard value.

The initial-developer container 27Y of the developing device 20Y shown in FIG. 4 is detachably attached to the body of the developing device. A nonvolatile RAM 42Y is fixed to an outer wall of the initial-developer container 27Y configured in the above manner. The nonvolatile RAM 42Y stores therein an identification (ID) number of the initial-developer container that also functions as a product ID of the developing device 20Y and loose apparent density information, which are electronic data, so as to be machine-readable by a reader 43. The loose apparent density information indicates loose apparent density information of toner in the initial developer encapsulated in the initial-developer container 27Y, and a measured value of the loose apparent density of the toner is stored in the nonvolatile RAM 42Y before shipping from a factory. It is noted that the toner concentration in the initial developer is controlled to 7% by weight.

Meanwhile, the controller 40 in the printer unit 1 stores correction data in a ROM 41 as a correction-data storage unit. The correction data is used to correct an upper limit (a lower limit in the case of toner concentration) of Vtref being a control target value of Vt based on an amount of displacement of the loose apparent density of the toner in the initial developer from the standard value (0.38 g/cm$^3$) More specifically, there is a satisfactory correlation between the amount of displacement and an amount of displacement of Vtref from an appropriate value. The correlation is basically constant irrespective of product lots of toner and toner-concentration detecting sensors. The correction data is constructed based on the results of examining the correlation by previously performed experiments. The correction data is used to correct the reference value of the upper limit of Vtref to a value so as not to cause the carrier adhesion, based on the amount of displacement of the loose apparent density of the toner contained in the initial developer from the standard value thereof.

Figure 5:
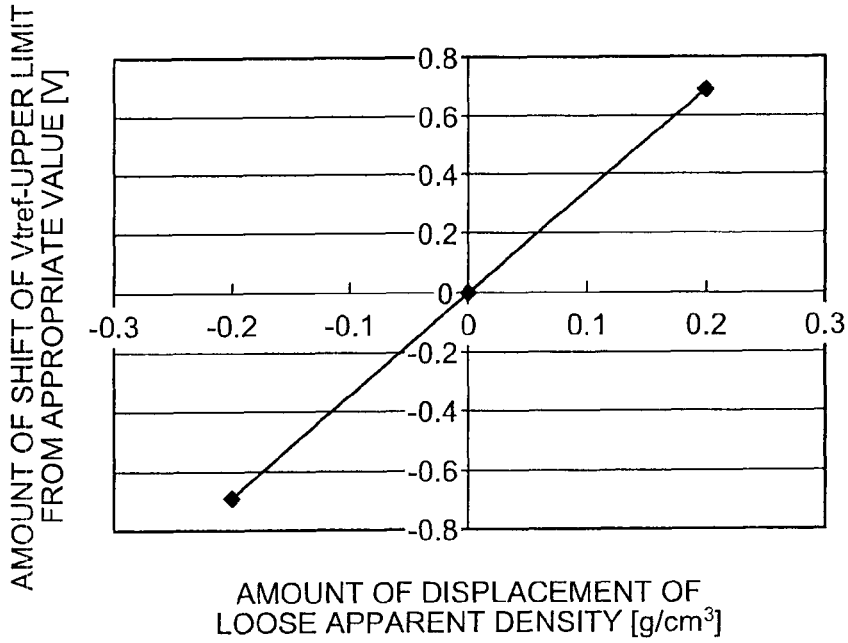
FIG. 5 is a graph representing an example of correction data stored in ROM of a controller in the printer unit.

FIG. 5 is a graph representing an example of the correction data stored in the ROM 41 of the controller 40 in the printer unit 1. The horizontal axis of the graph represents the amount of displacement of the loose apparent density of the toner contained in the initial developer from the standard value (0.38 g/cm$^3$) of the loose apparent density. The amount of displacement can be easily determined by subtracting the loose apparent density of the toner contained in the initial developer stored in the nonvolatile RAM 42Y from the standard value (0.38 g/cm$^3$) of the loose apparent density.

The vertical axis of the graph represents an amount of shift of the upper limit (lower limit of toner concentration) of Vtref from an appropriate value. By specifying the amount of shift corresponding to the amount of displacement based on the graph and adding the result of specification to the reference value of the upper limit, the upper limit of Vtref can be corrected to an appropriate value so as not to cause the carrier adhesion. The example of storing the graph (indicating a function) indicating a relationship between the amount of displacement and the amount of shift is explained as the correction data, however, any other form such as a graph representing a relationship between an appropriate value of the upper limit of Vtref and a loose apparent density may be stored in the ROM 41.

When the process unit 10Y is attached to the printer unit 1, a terminal (not shown) provided in a housing of the developing device 20Y comes in contact with a terminal (not shown) provided in the main body of the printer unit 1. The controller 40 of the printer unit 1 and the nonvolatile RAM 42Y of the initial-developer container 27Y can communicate with each other via a contact point between the both terminals. The process units 10M, 10C, and 10K have the same configuration as the process unit 10Y.

The controller 40 detects that a new process unit is set in the printer unit through the following process for each of the developing devices 20Y, 20M, 20C, and 20K. More specifically, when the process unit is removed from the printer unit 1, the controller 40 cannot communicate with the nonvolatile RAM because it is fixed to the initial-developer container of the developing device in the removed process unit. Meanwhile, when a process unit is set in the printer unit 1, the controller 40 can communicate with the nonvolatile RAM of the developing device in the set process unit although the communication cannot be performed until then. The controller 40 detects attachment or detachment of the process unit based on such successful or unsuccessful communication. When the attachment of the process unit is detected, it is determined, on an initial-developer container ID stored in the nonvolatile RAM of the developing device in the set process unit, whether a value before the attachment is detected coincides with a value after the attachment is detected. If the both values do not coincide with each other, it is detected that the process unit has been replaced with a new one.

Figure 6:
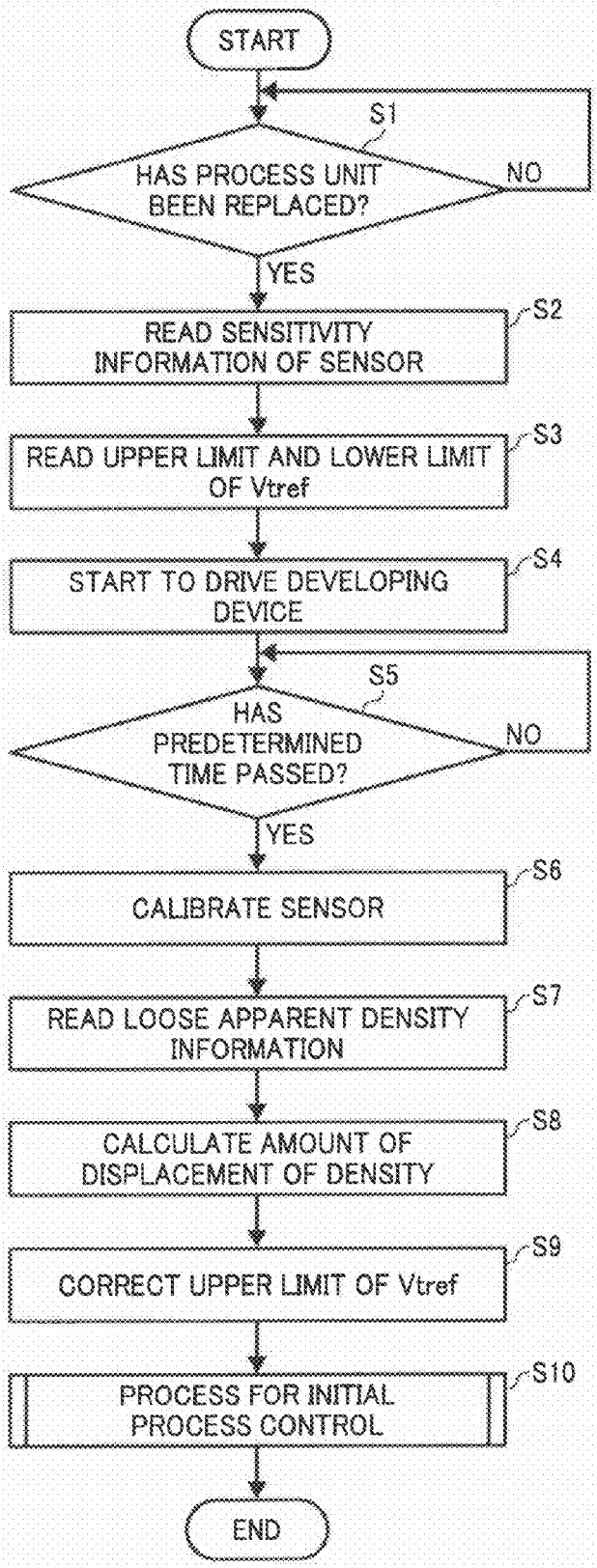
FIG. 6 is a flowchart of an initial control process after replacement of the process unit implemented by the controller.

When detecting the replacement of the process unit, the controller 40 executes an initial control process after replacement to the process unit. FIG. 6 is a flowchart of a control operation for the initial control process after the replacement of the process unit. When the replacement of the process unit is detected (YES (Y) at Step 1 (S1)), first, the sensitivity information stored in the IC chip of the toner-concentration detecting sensor incorporated in the developing device of the process unit is read (S2). Then, the upper limit of Vtref (lower limit of toner concentration) and the lower limit of Vtref (upper limit of toner concentration) of the toner-concentration detecting sensor are read (S3).

Next, the developer conveying device of the developing device starts to be driven (S4). Consequently, the initial developer in the initial-developer container of the developing device starts to be gradually fed into the developer conveying device with rotation of a screw element in the developer conveying device. After a predetermined time passes from the start of driving the developer conveying device (Y at S5), all the initial developer in the initial-developer container shifts into the developer conveying device and the toner in the initial developer is frictionally charged to a certain level by stirring the initial developer with the screw element. Thereafter, an output from the toner-concentration detecting sensor that uses the initial developer as an object to be detected is calibrated to 2.7 volts as a standard output voltage by controlling a control voltage to the toner-concentration detecting sensor (S6).

When the calibration of the toner-concentration detecting sensor is finished, then, the loose apparent density information stored in the nonvolatile RAM is read (S7), and an amount of displacement of density, being the amount of displacement of the loose apparent density of toner contained in the initial developer, from the standard value is determined (S8). Thereafter, the upper limit of Vtref (lower limit of toner concentration) is corrected based on the amount of displacement of the density and the correction data (S9), and then, the process for initial process control is executed (S10).

Figure 7:
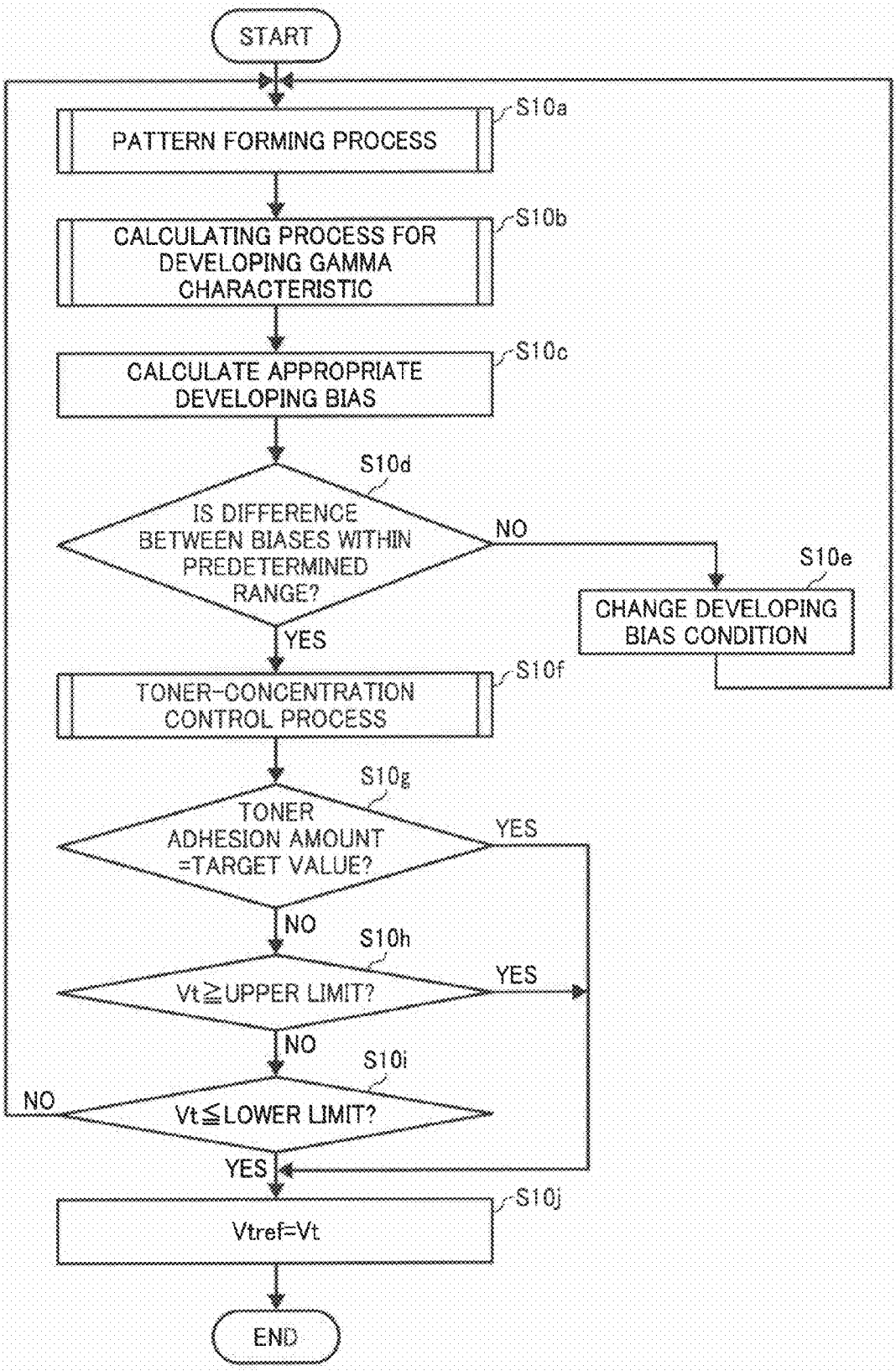
FIG. 7 is a flowchart of a process content of initial process control implemented by the controller.

The process for initial process control will be explained in detail below. FIG. 7 is a flowchart of a process content of the initial process control. In the process for initial process control, first, a pattern forming process for forming a toner patch pattern on the surface of a photosensitive element in the replaced process unit is executed (S10*a*). The toner patch pattern is formed of seven reference toner patch images arranged at a predetermined interval along the surface of the photosensitive element, and the individual reference toner patch images are developed under conditions of mutually different developing biases Vb.

In the pattern forming process, the photosensitive element is always uniformly charged with a constant charge amount, and an amount of exposure upon optical writing, when a patch latent image for the reference toner patch image is obtained, is also controlled to a constant value. Therefore, a difference in developing biases Vb of the reference toner patch images indicates a difference in developing potentials being a potential difference between an electrostatic latent image and a developing bias Vb. The larger the developing potential, the more the toner adhesion amount (image density) per unit area of a toner image. The seven reference toner patch images within the toner patch pattern are developed with larger developing bias Vb (developing potential) in their ascending order, or in their forming order of a first reference toner patch image, a second one, . . . , and a seventh one. Thus, the toner adhesion amounts of the seven reference toner patch images are getting larger in their ascending order. The reference toner patch image being a fourth one in the forming order is developed with a preset standard developing bias Vb. The toner patch pattern developed on the surface of the photosensitive element is transferred to the intermediate transfer belt 51.

When the pattern forming process is finished, a calculating process for a developing gamma characteristic is executed (S10*b*). In the calculating process for the developing gamma characteristic, first, toner adhesion amounts of the seven reference toner patch images within the toner patch pattern transferred to the intermediate transfer belt 51 are respectively detected by the first optical sensor or the second optical sensor in the optical sensor unit 69. Then, the developing gamma characteristic being a function representing a relationship between a developing bias Vb and a toner adhesion amount is determined using the method of least squares, based on a developing potential corresponding to each of the seven reference toner patch images and a result of detecting each toner adhesion amount corresponding to each of the seven reference toner patch images.

After the calculating process for the developing gamma characteristic is executed in the above manner, an appropriate developing bias being the developing bias Vb is calculated based on the developing gamma characteristic (S10*c*) so that a preset target toner adhesion amount (image density) is obtained. Here, by performing subsequent developing operations under the condition of the calculated appropriate developing bias, the target toner adhesion amount can be obtained without changing the toner concentration in the initial developer. However, upon initial printing, it is preferred, for convenience of management of subsequent imaging conditions, to perform development by changing the developing bias Vb to a value as close as possible to a standard developing bias (developing bias when the fourth reference toner patch image is formed).

It is therefore determined whether a difference between the appropriate developing bias and the standard developing bias is within a predetermined range (S10*d*). If it is not within the predetermined range (NO (N) at S10*d*), the developing bias condition is changed (S10*e*), and then, the pattern forming process is again performed. At this time, each of the seven reference toner patch images is developed with a different developing bias Vb from the developing bias used in the previous pattern forming process. Consequently, the fourth reference toner patch image is developed with a developing bias Vb being the same value as the previously calculated appropriate developing bias. Meanwhile, if the difference between the appropriate developing bias and the standard developing bias is within the predetermined range (Y at S10*d*), a toner-concentration control process and the pattern forming process are repeated until the toner adhesion amount of the fourth reference toner patch image becomes the target value, or the output voltage Vt of the toner-concentration detecting sensor becomes the same value as the upper limit, or the output voltage Vt becomes the same value as the lower limit (S10*f*→N at S10*g*→N at S10*h*→N at S10*i*→S10*a*).

In the toner-concentration control process (S10*f*), if the toner adhesion amount of the fourth reference toner patch image is smaller than the target value, then the toner supply device is driven to supply toner to the initial developer. However, if the output voltage Vt of the toner-concentration detecting sensor is equal to or lower than the lower limit, then the toner supply is stopped. If the toner adhesion amount of the fourth reference toner patch image is larger than the target value, then the toner in the initial developer is forcibly consumed by developing a predetermined image for toner forcible consumption on the photosensitive element and cleaning the image by the drum cleaning device. However, if the output voltage Vt of the toner-concentration detecting sensor is equal to or higher than the upper limit, then the toner forcible consumption is stopped. In almost cases, the toner forcible consumption is performed rather than the toner supply. The reason is that the toner in the initial developer is left standing for at least several months in the initial-developer container after it is shipped from the factory and this causes the toner to have almost no charge by that time, and that in many cases the toner is insufficiently charged even if it is stirred upon initial operation.

When the control of the toner concentration in the initial developer is appropriately finished, Vtref being the control target value of the output voltage Vt of the toner-concentration detecting sensor is set to the same value as the output voltage Vt at that time (S10*j*).

The present copier configured in the above manner corrects the upper limit of Vtref, with which lower-limit concentration of the toner concentration in the initial developer is controlled, to a value so as not to cause the carrier adhesion, based on the loose apparent density of the toner in the initial developer and the correction data. Thus, it is possible to minimize the carrier adhesion upon initial printing caused by variations in the loose apparent density of the toner contained in the initial developer while controlling the initial developer to toner concentration suitable for the environment and executing the initial printing.

The example of storing the loose apparent density of the toner in the initial developer in the nonvolatile RAM is explained, however, carrier density (bulk density) information of the initial developer may be stored therein instead of the loose apparent density information. In this case, data to correct the upper limit of Vtref as correction data may be stored in ROM of the controller based on the amount of displacement of the carrier density information.

In the present copier, each of the Y, M, C, and K toner cartridges that contain Y, M, C, and K toners respectively is provided with the nonvolatile RAM that stores therein the loose apparent density of the toner inside thereof. The controller is configured so that in the toner-concentration control process (S10*f*), when the toner is supplied to the initial developer, the lower limit of Vtref is appropriately corrected based on the supply amount, the loose apparent density information of the toner in the initial developer, and also the loose apparent density information of the toner in the toner cartridge.

Modified examples of the copier according to the first embodiment will be explained below. Each configuration of the copiers according to the modified examples is the same as that of the first embodiment unless otherwise specified.

A copier according to a first modified example uses developing devices, as the developing devices 20Y, 20M, 20C, and 20K, each of which housing bears a visible character or symbol representing loose apparent density information of the toner in the initial developer. For example, a human-visible number such as "0.39" is attached to the housing. A numerical value indicating the loose apparent density may be directly formed on a resin-made housing as a laser marker through laser processing, or a seal with a numerical value printed thereon may be attached to the housing.

The printer unit 1 includes a plurality of unit attachment/detachment detecting sensors (e.g., 30Y, see FIG. 4), each of which detects an attachment/detachment operation, in the process units 10Y, 10M, 10C, and 10K respectively. The unit attachment/detachment detecting sensor can only detect attachment/detachment of the process unit, and cannot thereby detect whether the process unit is replaced.

When the unit attachment/detachment detecting sensor 30Y detects the detachment operation of any one of the process units, the controller 40 causes a display unit such as a display (not shown) to display a message like "Has the developing device of the process unit for "certain" color been replaced with a new one?", querying the user about whether the developing device of the detached unit has been replaced. When the user enters information that it has been replaced, based on the message, to an operation unit for inputting data that is formed of a numeric keypad or the like, the controller 40 causes the display unit to display a message prompting for entry of a loose apparent density such as "Enter the number described on the case of the developing device". The user enters the loose apparent density information based on the message, and the controller 40 can thereby obtain the loose apparent density information. In other words, the operation unit functions as a data input unit that obtains the loose apparent density information expressed by the character or the symbol through input operation by the operator. When the loose apparent density information is entered, the controller 40 executes processes of the calibration of the toner-concentration detecting sensor, the correction of the upper limit of Vtref, and the initial process control, similarly to the first embodiment.

A copier according to a second modified example uses developing devices, as the developing devices 20Y, 20M, 20C, and 20K, each of which housing bears a barcode being a visible code pattern representing loose apparent density information of toner in the initial developer. For example, the barcode is the human-visible number such as "0.39". The barcode may be directly formed on a resin-made housing as a laser marker through laser processing, or a seal with a numerical value printed thereon may be attached to the housing.

The printer unit 1 includes a unit attachment/detachment detecting sensor (30Y: see FIG. 4) similarly to that in the copier according to the first modified example. When the unit attachment/detachment detecting sensor detects the detachment operation of any one of the process units, the controller 40 causes a display unit to display a message prompting for an operation of the scanner 300 to scan an image of the barcode attached to the developing device of the process unit. When the user sets the developing device on the contact glass of the scanner 300 according to the message and presses a copy start button so that the image of the barcode is read by the scanner 300, a barcode recognizing unit (not shown) of the printer unit 1 analyzes the number indicated by the barcode based on the same principle as that of known barcode readers, and sends the result of analysis to the controller 40. With this feature, the controller 40 can obtain the loose apparent density information.

More specifically, a combination of the scanner 300 and the barcode recognizing unit functions as a reading-converting unit that reads the image of the barcode being the code pattern and converts the barcode to loose apparent density information based on the result of reading. When the loose apparent density information is entered, the controller 40 executes processes of the calibration of the toner-concentration detecting sensor, the correction of the upper limit of Vtref, and the initial process control, similarly to the first embodiment.

The examples of the copier that forms a multicolor image by a plurality of process units are explained so far. However, the present invention is applicable to an image forming apparatus in a system of including one photosensitive element and a plurality of developing devices arranged around the periphery of the photosensitive element to obtain a multicolor image. The multicolor image is obtained in such a manner that toner images of mutually different colors are sequentially formed on the photosensitive element by developing using the developing devices for different colors and the toner images of different colors are transferred to the intermediate transfer element in a superimposed manner. The present invention is also applicable to an image forming apparatus that forms only a monochrome image.

In the copier according to the first embodiment, the initial-developer container is detachably attached to the body of the developing device, and the nonvolatile RAM being a density-information storage unit is provided in the initial-developer container. Based on the configuration, even when the developer in the developing device is removed and discarded caused by degradation of the magnetic carrier in the developing device used for a certain period of time and a new initial-developer container is attached to the developing device so that a new initial developer is set therein, the upper limit of Vtref (lower limit of toner concentration) can be corrected to an appropriate value so as not to cause the carrier adhesion based on loose apparent density information of toner in the newly set initial developer.

The copier according to the first embodiment includes the photosensitive element being a latent-image carrier that carries a latent image, the optical writing unit being a latent-image forming unit that forms a latent image on the photosensitive element, and the developer conveying device being a developer container that accommodates the developer containing toner and magnetic carrier. The copier also includes the toner-concentration detecting sensor being the toner-concentration detecting unit that detects toner concentration in the developer inside of the developer conveying device, the developing devices each including the developing sleeve being the developer carrier that carries the developer inside the developer conveying device on the surface thereof and develops the latent image on the photosensitive element using the developer, and the toner supply device being the toner supply unit that supplies toner to the developer conveying device. The copier further includes the controller that executes the toner-concentration control process being a toner-concentration decreasing process for the initial developer in which toner concentration in the initial developer is decreased based on a predetermined lower-limit concentration (upper limit of Vtref) as a limit, by developing a predetermined image for toner consumption on the photosensitive element. The development is performed based on the result of detection by the toner-concentration detecting sensor that uses the initial developer being a new developer set in the developing device as an object to be detected.

The copier further includes the reader being a reading unit that machine-reads the loose apparent density information stored in the nonvolatile RAM, and a ROM being the correction-data storage unit that stores therein correction data to correct the upper limit of Vtref, which is the lower limit of a control target of the toner concentration, based on the loose apparent density of the toner in the initial developer. The controller is configured so as to execute the process for correcting the upper limit of Vtref (lower limit of toner concentration) based on the loose apparent density information obtained by the reader and the correction data. With this configuration, attachment of a new developing device (or a process unit incorporating a new developing device) to the printer unit 1 allows the reader to automatically obtain the loose apparent density information of the toner in the initial developer.

In the copier according to the first embodiment and the copiers according to the modified examples, any device as follows is used as the toner-concentration detecting sensor, the device including the built-in IC chip being a sensitivity storage unit that stores therein machine-readable sensitivity information which is the rate of change of an output signal with respect to a change in toner concentration. Further, the controller is configured so as to correct the upper limit of Vtref (lower limit of toner concentration) based on the sensitivity information stored in the IC chip and the loose apparent density information of the toner in the initial developer. In the configuration, the upper limit of Vtref can be set to an appropriate value corresponding to the sensitivity specific to the individual toner-concentration detecting sensors.

The copier according to the first modified example uses the developing devices each of which housing bears a visible character or symbol representing the loose apparent density information, and also uses the operation unit being a data input unit, as an information acquisition unit, that acquires a character or a symbol through an input operation by the operator. In the configuration, by prompting the operator for an input operation, the loose apparent density of the initial developer can be acquired.

The copier according to the second modified example uses developing devices, as the developing devices, each of which housing bears a barcode or a visible code pattern representing the loose apparent density information, and also uses the reading-converting unit (scanner 300 and the barcode recognizing unit), as an information acquisition unit, that reads the image of the barcode and converts the barcode to loose apparent density information based on the result of reading. In the configuration, the loose apparent density of the initial developer can be acquired without prompting the user to interpret and input a number or a symbol.

The copiers according to the first and the second modified examples can avoid loss of the loose apparent density information due to peeling off of the seal with the loose apparent density information printed thereon when the housing of the developing device bears the character, the symbol, or the barcode as the laser maker made by laser processing.

In the copiers according to the first and the second modified examples, when the seal bearing the character, the symbol, or the barcode is attached to the housing of the developing device, the seal is peeled off from the housing of the used developing device, and the developing device with the housing cleaned is sent to a recycling process to obtain a recycled developing device, so that the recycled developing device can easily bear new loose apparent density information by again attaching the seal thereto.

An image forming apparatus and a developing device according to a second embodiment of the present invention will be explained below. An example of toner concentration sensors (magnetic permeability sensors) 45Y, 45M, 45C, and 45K (hereinafter, "magnetic permeability sensor 45") being bulk-density sensors will be explained below as the toner-concentration detecting unit. The configurations of the image forming apparatus (copier), process units, and developing devices are the same as these of FIGS. 1 to 3, and thus explanation thereof is omitted.

Figure 8:
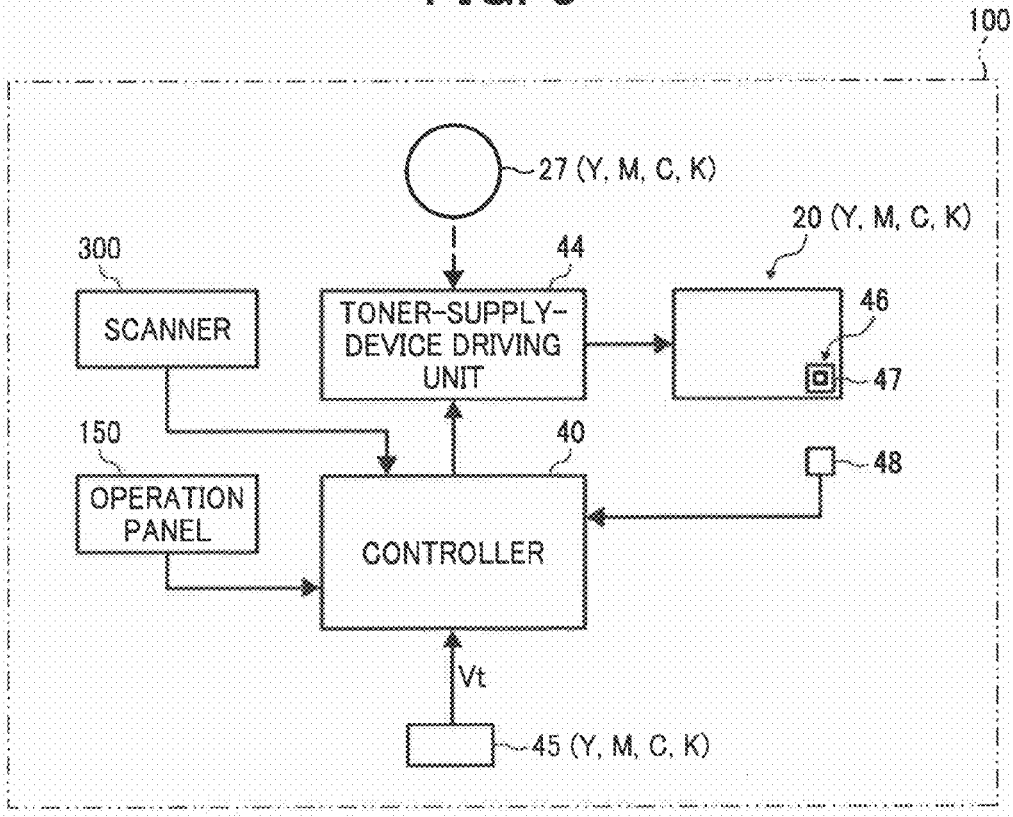
FIG. 8 is a block diagram of a main configuration of an entire copier according to a second embodiment of the present invention.

FIG. 8 is a block diagram of the main configuration of an entire copier according to the second embodiment. In FIG. 8, the same reference numerals are assigned to functions the same as these of FIG. 4. In this figure, reference numeral 46 represents an ID chip provided in each developing device 20, 47 a nonvolatile memory (ROM) provided in the ID chip 46, 48 a reader that reads the information of the ID chip 46, and 150 an operation panel.

As explained above, each developing device 20 stores two-component developer that contains toner and magnetic carrier in the body of the developing device. The developing device 20 includes a developing roller being a developer carrier that has a plurality of magnets inside of a rotatable nonmagnetic sleeve, a conveying unit that stirs and conveys the developer, the magnetic permeability sensor 45 being the toner-concentration detecting unit that detects toner concentration in the developer or being the bulk-density sensor, and the controller 40 that controls toner concentration based on the result of detection by the toner-concentration detecting unit.

The image forming apparatus includes a controller that processes information read by the scanner 300. In the second embodiment, the controller 40 of the developing device 20 functions also as the controller, however, the controller may be provided discretely from the controller 40. The controller 40 may be disposed in each developing device, however, in the second embodiment, four developing devices are controlled by one controller 40.

The controller 40 is formed of a known computer, and is configured so that various set values and initial values, programs related to image forming operation, and programs and set values related to toner concentration are previously stored, and the programs are started in response to an operation of a start key (not shown), to execute the image forming operation and the control of toner concentration, or the like.

Because the toner concentration of the developer in the developing device 20 decreases caused by consumption of the developer due to image formation, the toner concentration is kept to almost constant by supplying toner to the developing device 20 from a developer container (toner cartridge) 27(Y, M, C, and K) that contains toner of each color as required as shown in FIG. 8, by driving a toner-supply-device driving unit (powder pump) 44 based on an image area and a detected value (Vt) of the magnetic permeability sensor 45. A relationship between an output (Vt) of the magnetic permeability sensor 45 and toner concentration has such characteristic that the toner concentration decreases as the output increases while the toner concentration increases as the output decreases.

The toner supply operation is implemented in such a manner that based on a difference ΔT (=Vref−Vt) between a toner-concentration target value (Vref) previously stored in the controller 40 and an output (Vt) of the magnetic permeability sensor 45, toner is not supplied when ΔT is positive because the toner concentration is satisfactory while a toner supply amount is increased with an increase in |ΔT| when ΔT is negative, so that the output (Vt) is getting close to the toner-concentration target value Vref. Furthermore, the toner-concentration target value Vref, the charging potential, and the amount of light are set by performing a process control once in 10 sheets (about 5 sheets to 200 sheets depending on a copy speed or the like). Specifically, the process control is a setting mode so that each adhesion amount of a plurality of halftones and of solid patterns formed on the photosensitive element 11 is converted using a reflection concentration sensor to obtain a target adhesion amount. The control of toner concentration is executed by the controller 40.

An output of the magnetic permeability sensor 45 for the initial developer is generally controlled based on the reference toner concentration. Therefore, in a case of other toner concentrations, an output is calculated from a relational expression between an output of the magnetic permeability sensor 45 based on the reference toner concentration and toner concentration. The upper limit of the toner concentration is controlled so that a sensor output value, when the toner concentration is the upper limit determined from a relational expression between the reference toner and an output of the magnetic permeability sensor 45, is input into the controller 40 and the sensor output value does not exceed an upper-limit set value of the toner concentration. The same goes to the lower limit of the toner concentration.

Figure 9A:
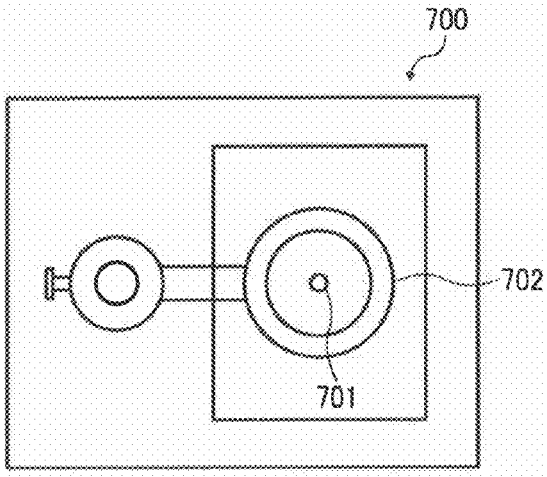
FIGS. 9A and 9B are schematics of a bulk-density measuring unit according to the second embodiment.
Figure 9B:
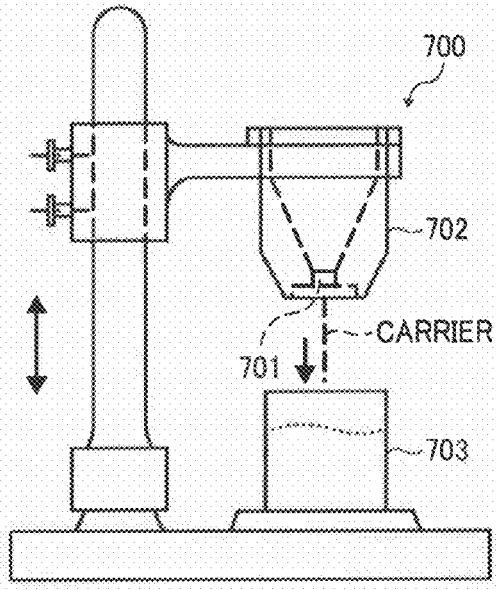

The bulk density of carrier in the present invention is measured using a bulk-density measuring unit 700 shown in FIGS. 9A and 9B. The bulk density is measured according to a metal powder-apparent density testing method based on Japan Industrial Standards (JIS-Z-2504). The bulk-density measuring unit 700 includes a container 702 whose height is adjustable and a cylindrical container 703, and causes carrier from the container 702 formed of an orifice 701 with a diameter of 2.5 millimeters inside thereof to be naturally discharged, and the carrier is flowed into a stainless-made cylindrical container 703 of 25 $cm^3$ set right under the container 702 so as to overflow the cylindrical container 703. Thereafter, the top surface of the container is flatly scraped off along the upper edge of the cylindrical container 703 at one operation using a nonmagnetic flat pallet. If the carrier is difficult to be discharged through the orifice 701 with the diameter of 2.5 millimeters, then the carrier is discharged through an orifice with a diameter of 5 millimeters.

With this operation, a weight of carrier per $cm^3$ is determined by dividing the weight of the carrier flowed into the cylindrical container 703 by 25 $cm^3$ as the volume of the container. In the present invention, the determined weight is defined as the bulk density of the carrier. The bulk density may not particularly be measured under the conditions if it can be determined using the same principle or rule as above.

The bulk density of the carrier forming the developer is 2.35 $g/cm^3$ or more, more preferably 2.40 $g/cm^3$ or more, and this preferred value is useful for preventing the carrier adhesion. A core material with a low bulk density is porous or has large irregularities of its surface. If the bulk density is low, a value of substantial magnetic moment per particle becomes small even if magnetic moment (emu/g) at 1 KOe is large, and thus, this is disadvantageous for the carrier adhesion. Moreover, if the irregularities are large, the thickness of a coat resin is nonuniform depending on locations, which causes unevenness of the charge amount and the resistance to easily occur, and this affects the durability and the carrier adhesion over time.

The bulk density can be increased by rising a firing temperature, however, because core materials easily adhere to each other and are not easy to be crashed, the bulk density is preferably less than 2.50. Consequently, the bulk density is preferably 2.35 $g/cm^3$ to 2.50 $g/cm^3$, more preferably 2.40 $g/cm^3$ to 2.50 $g/cm^3$.

EXAMPLE

The present invention will further be explained using Example, however, the present invention is not limited thereto.

Samples with different bulk densities of carrier in the initial developer are prepared. The bulk densities of the carrier used here are three types of 2 $g/cm^3$, 2.4 $g/cm^3$, and 2.8 $g/cm^3$. The reference value of the bulk density in this case is 2.4 $g/cm^3$.

The image forming apparatus controls outputs (Vt) of the magnetic permeability sensor 45 for an initial developer (7 wt % of initial developer is used in the present invention) and makes uniform the output values upon 7% by weight. Under ordinary circumstances, when carrier with the same bulk density as that of the carrier used for the initial developer is used, it is ideal that even developers with different bulk densities will have the same toner concentration if the outputs (Vt) of the magnetic permeability sensor 45 are the same as each other. Actually, however, each relationship between the output (Vt) of the magnetic permeability sensor 45 and the toner concentration differs according to the bulk density of carrier contained in the developer.

When the upper and lower limits of the toner concentration are controlled by an output (Vt) of the magnetic permeability sensor 45, and if the bulk density is higher than that of the reference carrier, the toner concentration that reaches the toner-concentration upper limit or lower limit is higher than that of the reference carrier. Conversely, if the bulk density is low, the toner concentration reaching the upper limit or the lower limit is lower than that of the reference carrier.

To correct this phenomenon, the following processes were performed, so that toner concentrations upon reaching the toner-concentration upper limit can be made uniform. More specifically, the processes include determining the toner concentration reaching the toner-concentration upper limit based on the bulk density and the output (Vt) of the magnetic permeability sensor 45, and determining a relational expression between the bulk density of the carrier in the initial developer and the toner-concentration upper limit. The processes also include inputting the relational expression to a toner-concentration controller, determining a difference between the input bulk density of the carrier and the bulk density of the reference carrier, and determining a differential value of toner concentration to be corrected. The processes further include changing a toner-concentration upper limit used for control by adding the determined difference to the toner-concentration upper limit, and changing a lower limit of the output (Vt) of the magnetic permeability sensor 45 for each bulk density by feeding back the changed upper limit to the output (Vt) of the magnetic permeability sensor 45.

Figure 10:
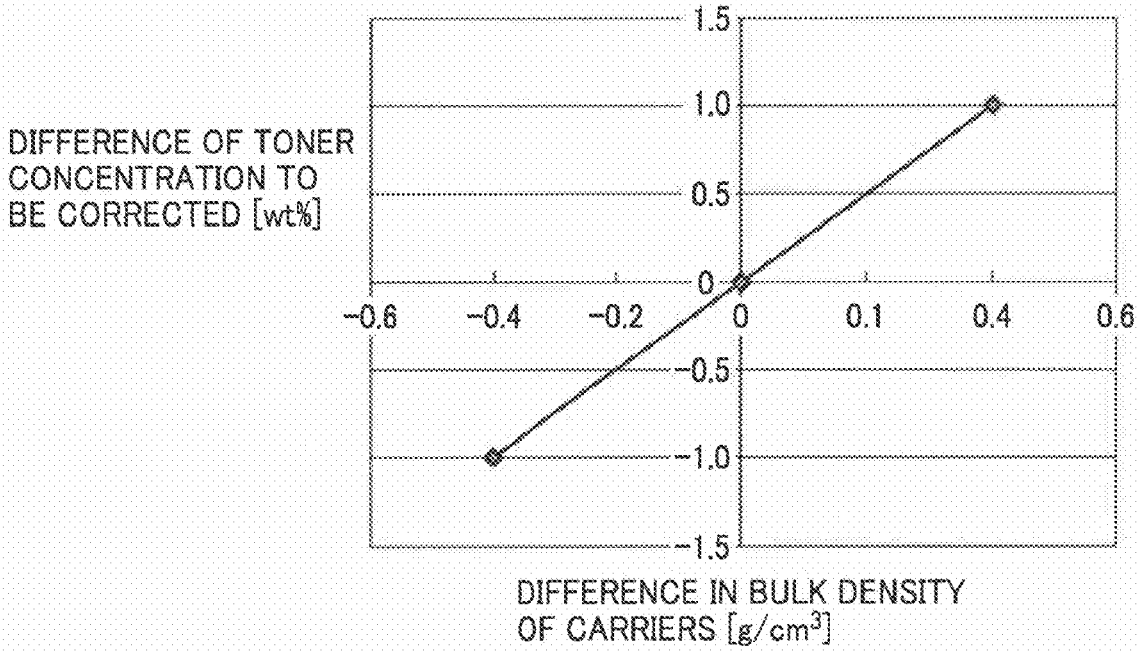
FIG. 10 is a graph representing a relationship between a difference in bulk densities and a correction value of toner concentration.
Figure 11:
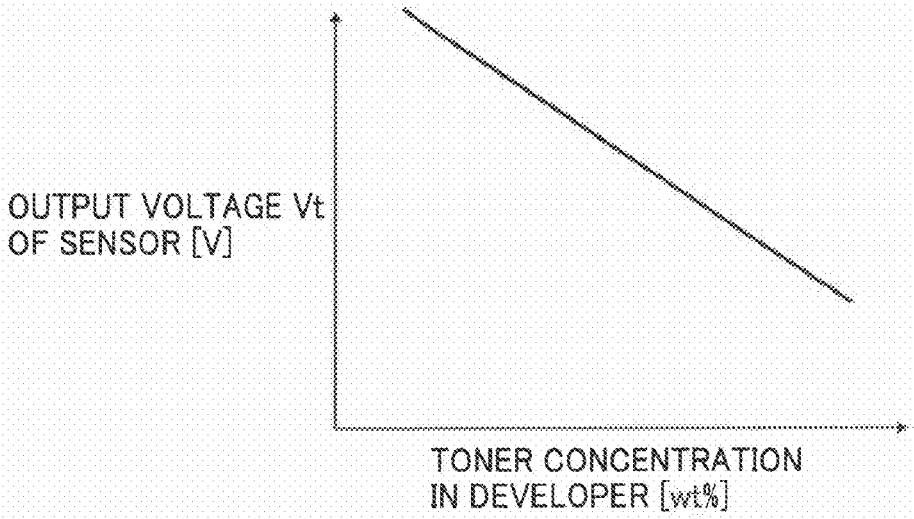
FIG. 11 is a graph representing an example of a relationship between an output voltage Vt of a toner-concentration detecting sensor formed of a magnetic permeability sensor and toner concentration in developer.
Figure 12:
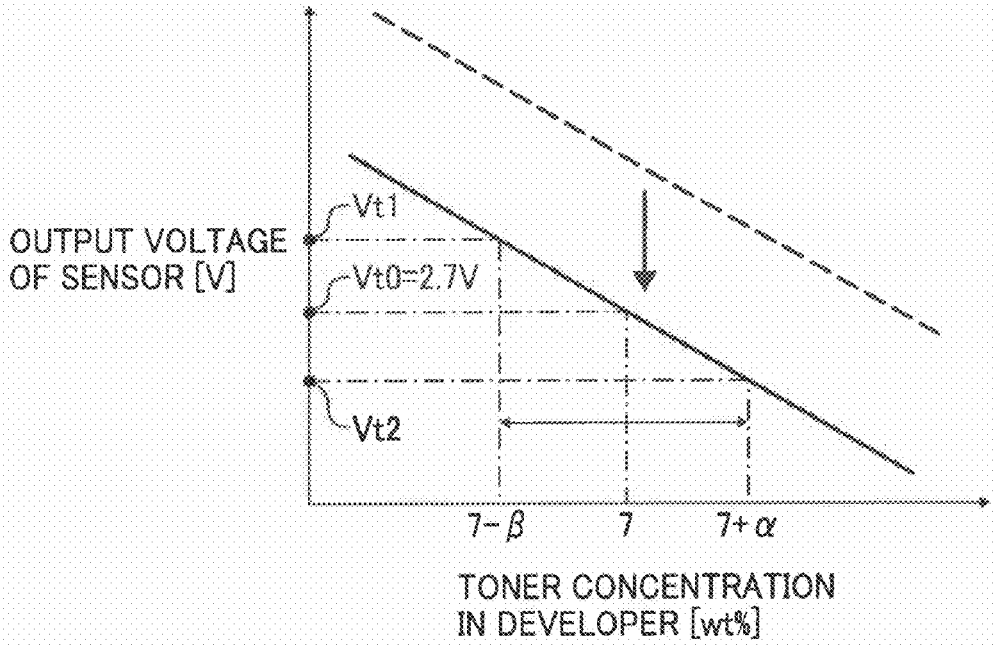
FIG. 12 is a graph representing the relationship after the toner-concentration detecting sensor is calibrated.
Figure 13:
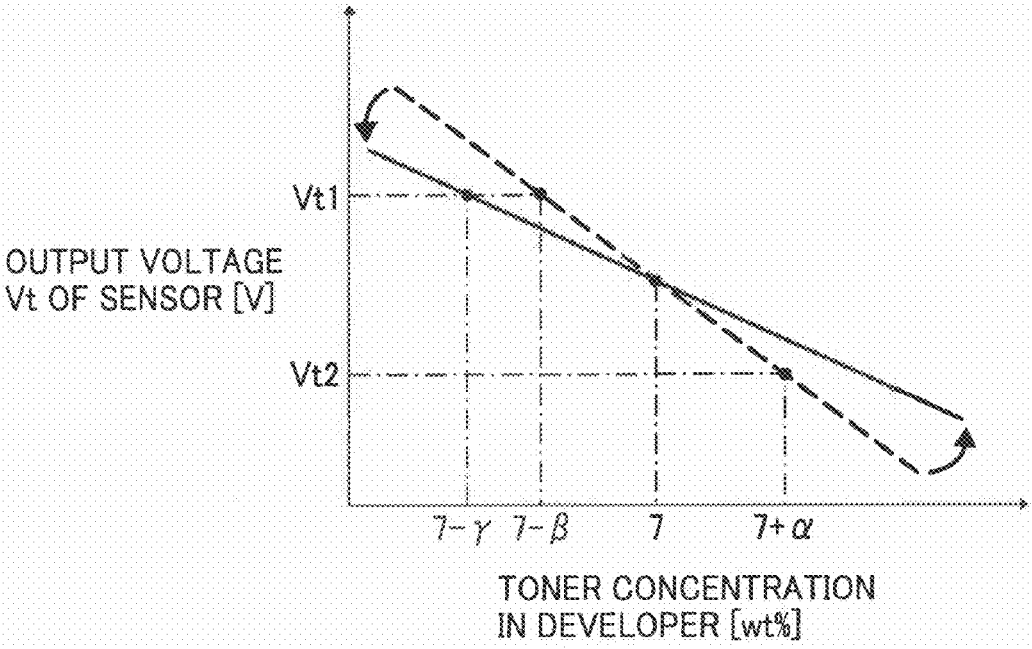
FIG. 13 is a graph representing a change in a slope of the relationship due to variation of a loose apparent density of toner contained in the initial developer.

The same goes for a toner-concentration lower limit. The toner-concentration lower limit could be kept constant by changing the upper limit of the output (Vt) of the magnetic permeability sensor 45. FIG. 10 is a graph representing a relationship between a difference of the bulk densities and a correction value of toner concentration.

To obtain the value, the bulk density of the carrier contained in the initial developer to be used needs to be input to the controller 40. The method of inputting the bulk density includes some methods as follows. One of the methods includes writing a number representing the bulk density information of carrier on the developing device 20 with a laser marker and inputting the number through the operation panel 150. Another one of the methods includes setting bulk density information of carrier to a code symbol such as a barcode, attaching the code symbol to the body of the developing device 20, reading the code symbol by the scanner 300 that reads an image of an original, and inputting the read information into the controller 40 to perform a recognition process, so that the processed information can be recognized as the bulk density information of carrier. The method of reading the code symbol is implemented in such a manner that by providing a code symbol scanner so that the code symbol can be read from the developing device 20 being set in the main body of a copier 100, the bulk density information can reliably be input to the controller 40 without failing to input.

As shown in FIG. 8, the ID chip 46 with the recordable nonvolatile ROM 47 mounted thereon is provided in the body of the developing device, and bulk density information of carrier is stored in the nonvolatile ROM 47. If the reader 48 is provided as an information collecting unit to read the information from the ID chip 46 when the developing device 20 is set in the main body of the copier, the reader 48 reads the information in the ID chip 46 upon turning on of power for the image forming apparatus or upon replacement of the developing device 20, and inputs the read information to the controller 40. With this operation, even when the developing device 20 is replaced with a different one in the same image forming apparatus, by changing the upper and lower-limit set values of an output (Vt) of the magnetic permeability sensor 45, the upper limit and the lower limit of the toner concentration are the same as these of the reference carrier.

In the second embodiment, the photosensitive element 11 and the developing device 20 are integrally formed into a process cartridge that is detachably attached to the main body of the copier 100, which allows easy maintenance.

The second embodiment includes the ID chip 46. The upper limit and the lower limit of the toner concentration can thereby be made the same as these of the reference carrier upon use by inputting the bulk density of the carrier in the initial developer in the nonvolatile ROM, calculating the upper and lower limits of toner concentration by the controller 40 based on the input value, and converting the calculated values to an upper-limit set value and a lower-limit set value of an output (Vt) of the magnetic permeability sensor 45. Thus, the upper and lower limits of toner concentration can be accurately set even if manufacturing variations of toner are large.

According to one embodiment of the present invention, the upper limit used to control the lower limit concentration of the toner concentration in the initial developer is corrected to such a value that the carrier adhesion is not caused, based on the loose apparent density of the toner in the initial developer and the correction data. Therefore, it is possible to minimize the carrier adhesion upon initial printing caused by variations in the loose apparent density of toner contained in the initial developer while controlling toner concentration in the initial developer to toner concentration suitable for the environment and executing the initial printing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a developer container that contains developer including toner and carrier;

a toner-concentration detecting unit that detects toner concentration of the developer in the developer container;

a developer carrier that carries the developer in the developer container on its surface and develops a latent image on a latent-image carrier with the developer, wherein at least one of an information attaching unit and a density-information storage unit is provided in the developing device before shipment of the developing device, the information attaching unit attaches either one of carrier density information of initial developer, which is new developer set in the developing device, and loose apparent density information of toner in the initial developer, to a housing of the developing device, the density-information storage unit stores therein either one of the carrier density information and the loose apparent density information as electronic data, the toner-concentration detecting unit is a bulk-density sensor for detecting toner concentration in two component developer containing toner and carrier, and the developing device further comprises a development controller that controls upper and lower limits of the toner concentration in the developer by an output value of the toner-concentration detecting unit and that corrects control values for the upper and lower limits of the toner concentration by changing an amount of shift of the control values of the upper and lower limits of toner concentration from an appropriate value for the toner concentration, based on either one of the carrier density information and the loose apparent density information, wherein the upper limit is higher than the lower limit.

2. The developing device according to claim 1, further comprising an initial-developer container that contains the initial developer, the initial-developer container being attached in a detachable manner to a body of the developing device, wherein the information attaching unit attaches either one of the carrier density information and the loose apparent density information to the initial-developer container, and the density-information storage unit is provided in the initial-developer container.

3. The developing device according to claim 1, wherein the development controller determines a difference between a reference value of the bulk density of the carrier by the toner-concentration detecting unit and bulk density of carrier actually used when the developer is prepared, and corrects the upper and lower limits of the toner concentration based on the difference.

4. The developing device according to claim 3, wherein as the information attaching unit, information for the bulk density of the carrier used upon preparation of the developer is written on the body of the developing device so as to be recognizable.

5. The developing device according to claim 4, wherein the information for the bulk density of the carrier is written on the body of the developing device using a laser marker so as to be recognizable.

6. The developing device according to claim 4, wherein a code symbol representing the information for the bulk density of the carrier is attached to the body of the developing device so as to be recognizable.

7. The developing device according to claim 4, wherein the bulk-density sensor is a magnetic permeability sensor.

8. The developing device according to claim 3, comprising, as the density information storage unit, a nonvolatile memory that can record information on development, wherein the information for the bulk density of the carrier is recorded in the nonvolatile memory so as to be recognizable.

9. An image forming apparatus comprising:

a latent-image carrier that carries a latent image thereon;

a latent-image forming unit that forms a latent image on the latent-image carrier;

a developing device comprising a developer container that contains developer including toner and carrier; a toner-concentration detecting unit that detects toner concentration of the developer in the developer container; and a developer carrier that carries the developer in the developer container on its surface and develops a latent image on a latent-image carrier with the developer;

wherein at least one of an information attaching unit and a density-information storage unit is provided in the developing device before shipment of the developing device, the information attaching unit attaches either one of carrier density information of initial developer, which is new developer set in the developing device, and loose apparent density information of toner in the initial developer, to a housing of the developing device, and the density-information storage unit stores therein either one of the carrier density information and the loose apparent density information as electronic data;

a controller that executes processes for developing a predetermined image for toner consumption on the latent-image carrier and decreasing toner concentration in the initial developer while maintaining a state in which an output value, from the toner-concentration detecting unit that uses the initial developer being new developer set in the developing device as an object to be detected, becomes a value in a lower toner concentration than a predetermined threshold;

a developer-information acquiring unit that acquires either one of carrier density information and loose apparent density information of the developing device by either one of an information acquiring unit and a reader, the information acquiring unit acquiring either one of the carrier density information and the loose apparent density information attached to the developing device, and the reader machine-reading the loose apparent density information stored in the density-information storage unit; and a correction-data storage unit that stores therein correction data to correct the threshold based on either one of the carrier density in the initial developer and the loose apparent density of toner in the initial developer, wherein the controller corrects the threshold by changing an amount of shift of the threshold from an appropriate value for the toner concentration, based on either one of the carrier density information and the loose apparent density information acquired by the developer-information acquiring unit and the correction data.

10. The image forming apparatus according to claim 9, wherein the toner-concentration detecting unit includes a sensitivity storage unit that stores therein information for sensitivity being a rate of change of an output signal with respect to a change in toner concentration so as to be machine-readable, and the controller corrects the threshold based on stored information for sensitivity and either one of the carrier density information and the loose apparent density information.

11. The image forming apparatus according to claim 9, wherein a developing device is used as the developing device in such a manner that a recognizable character, symbol, or code pattern representing either one of the carrier density information and the loose apparent density information is attached to a housing of the developing device, and a data input unit is used as the information acquiring unit, and the character, the symbol, or the code pattern is acquired by the data input unit through an input operation by an operator.

12. The image forming apparatus according to claim 11, wherein the character, the symbol, or the code pattern is attached to the housing by laser processing.

13. The image forming apparatus according to claim 11, wherein a seal bearing the character, the symbol, or the code pattern is attached to the housing.

14. The image forming apparatus according to claim 9, wherein a developing device is used as the developing device in such a manner that a recognizable character, symbol, or code pattern representing either one of the carrier density information and the loose apparent density information is attached to a housing of the developing device, and a reading-converting unit is used as the information acquiring unit, the reading-converting unit reading an image of the character, the symbol, or the code pattern and converting the image to either one of the carrier density information and the loose apparent density information based on the result of reading.

15. The image forming apparatus according to claim 9, further comprising an operation panel, wherein an upper limit and a lower limit of the toner concentration is controlled based on the bulk density information of the carrier input through the operation panel and written on the body of the developing device.

16. The image forming apparatus according to claim 9, further comprising:

an image reader that reads an image of an original; and a controller that processes read information, wherein a code symbol attached to the body of the developing device is read by the image reader, and an upper limit or a lower limit of the toner concentration is controlled based on read information for the bulk density of the carrier.

17. The image forming apparatus according to claim 9, wherein the developer-information acquiring unit acquires information for bulk density of carrier written on the body of the developing device in response to setting of the developing device in the main body of the image forming apparatus, and the controller uses acquired information as control parameters for an upper limit and a lower limit of the toner concentration in the developing device.

18. A process unit comprising at least a latent-image carrier and a developing device held by a common holder, the process unit being integrally formed into one unit and attached in a detachable manner to a main body of an image forming apparatus, wherein the developing device includes a developer container that contains developer including toner and carrier, a toner-concentration detecting unit that detects toner concentration of the developer in the developer container, and a developer carrier that carries the developer in the developer container on its surface and develops a latent image on the latent-image carrier with the developer, wherein at least one of an information attaching unit and a density-information storage unit is provided in the developing device before shipment of the developing device, the information attaching unit attaches either one of carrier density information of initial developer, which is new developer set in the developing device, and loose apparent density information of toner in the initial developer, to a housing of the developing device, the density-information storage unit stores therein either one of the carrier density information and the loose apparent density information as electronic data, the toner-concentration detecting unit comprises a bulk-density sensor for detecting toner concentration in two component developer containing toner and carrier, and the developing device further comprises a development controller that controls upper and lower limits of the toner concentration in the developer by an output value of the toner-concentration detecting unit and that corrects control values for the upper and lower limits of the toner concentration by changing an amount of shift of the control values of the upper and lower limits of toner concentration from an appropriate value for the toner concentration, based on either one of the carrier density information and the loose apparent density information, wherein the upper limit is higher than the lower limit.

19. An image forming apparatus comprising a process unit according to claim 18.

* * * * *